US011776500B2

(12) United States Patent
Sasaki

(10) Patent No.: US 11,776,500 B2
(45) Date of Patent: Oct. 3, 2023

(54) LIQUID-CRYSTAL DISPLAY APPARATUS AND DRIVING METHOD

(71) Applicant: Sharp Display Technology Corporation, Kameyama (JP)

(72) Inventor: Osamu Sasaki, Kameyama (JP)

(73) Assignee: SHARP DISPLAY TECHNOLOGY CORPORATION, Kameyama (JP)

( * ) Notice: Subject to any disclaimer, the term of this patent is extended or adjusted under 35 U.S.C. 154(b) by 0 days.

(21) Appl. No.: 17/901,893

(22) Filed: Sep. 2, 2022

(65) Prior Publication Data

US 2023/0105542 A1 Apr. 6, 2023

(30) Foreign Application Priority Data

Oct. 1, 2021 (JP) ..... 2021-162779

(51) Int. Cl.
*G09G 3/36* (2006.01)

(52) U.S. Cl.
CPC ... *G09G 3/3677* (2013.01); *G09G 2300/0852* (2013.01); *G09G 2310/08* (2013.01); *G09G 2320/0233* (2013.01); *G09G 2320/0247* (2013.01); *G09G 2320/043* (2013.01); *G09G 2320/046* (2013.01)

(58) Field of Classification Search
CPC ..... G09G 3/3677; G09G 2300/0852; G09G 2310/08; G09G 2320/0233; G09G 2320/0247; G09G 2320/043; G09G 2320/046
See application file for complete search history.

(56) References Cited

U.S. PATENT DOCUMENTS

2007/0013573 A1* 1/2007 Hashimoto ..... G09G 3/3614 341/172
2015/0177582 A1* 6/2015 Lai ..... G02F 1/136286 349/43
2018/0012540 A1* 1/2018 Hosoyachi ..... G09G 5/10
2019/0108805 A1 4/2019 Kondoh et al.
2020/0286435 A1* 9/2020 Feng ..... G09G 3/20

FOREIGN PATENT DOCUMENTS

JP 2002-091391 A 3/2002
JP 2019-070770 A 5/2019

* cited by examiner

*Primary Examiner* — Michael A Faragalla
*Assistant Examiner* — Sujit Shah
(74) *Attorney, Agent, or Firm* — KEATING & BENNETT, LLP

(57) ABSTRACT

Multiple adjustment capacitors corresponding to multiple source bus lines on a one-to-one correspondence basis are arranged. Each adjustment capacitor includes a first electrode supplied with an adjustment signal and a second electrode connected to the source bus line. The adjustment capacitors are divided into multiple groups. An adjustment signal having a amplitude different from group to group is supplied to the adjustment capacitor. A potential of the adjustment signal is raised after a liquid-crystal capacitor is charged in a pixel formation region including a thin-film transistor (TFT) that is turned on with a gate driver causing a scanning signal to rise and before the gate driver causes the scanning signal to fall.

7 Claims, 20 Drawing Sheets

LIQUID-CRYSTAL DISPLAY APPARATUS AND DRIVING METHOD

BACKGROUND

1. Field

The present disclosure relates to a liquid-crystal display apparatus having a common electrode supplied with a constant potential and a driving method of the liquid-crystal display apparatus.

2. Description of the Related Art

One of active-matrix type liquid-crystal display apparatuses of related art has a display including multiple source bus lines (video signal lines), multiple gate bus lines (scanning signal lines), and multiple pixel formation regions respectively arranged at intersection points of the source bus lines and the gate bus lines. Referring to FIG. 14, each pixel formation region 70 includes a pixel thin-film transistor (TFT) 71, a pixel electrode 72, a common electrode 73, and a liquid-crystal capacitor Clc. The gate terminal of the TFT 71 is connected to a gate bus line GL passing through a corresponding intersection point and the source terminal of the TFT 71 is connected to a source bus line SL passing through the intersection point. The pixel electrode 72 is connected to the drain terminal of the TFT 71. The common electrode 73 serving as a counter electrode is commonly shared by the pixel formation regions 70 and supplied with a constant potential. The liquid-crystal capacitor Clc is created by the pixel electrode 72 and the common electrode 73.

If the TFT 71 is an n-channel TFT, a video signal is written on the liquid-crystal capacitor Clc throughout which the scanning signal applied to a corresponding gate bus line GL remains at a high level (gate-on potential Vgh). When the scanning signal transitions from a high level to a low level (gate-off potential Vgl), the writing of the video signal onto the liquid-crystal capacitor Clc is complete. When the scanning signal transitions from the high level to the low level, a pixel potential (the potential of the pixel electrode 72) lowers because of the presence of parasitic capacitance Cgd between the pixel electrode 72 and the gate bus line GL. A voltage corresponding to a decrease in the pixel potential is referred to as a "pulldown voltage." In the discussion that follows, the transition of the pixel potential from the low level to the high level is referred to as a "rise of the scanning signal," and the transition of the pixel potential from the high level to the low level is referred to as a "fall of the scanning signal."

The liquid-crystal display apparatus performs alternating current (AC) drive to control degradation of liquid crystal. For this reason, a period while a liquid-crystal application voltage is maintained positive alternates with a period while the liquid-crystal application voltage is maintained negative. A common electrode potential (the potential of the common electrode 73) is thus set in view of the AC drive. In the following discussion, the common electrode potential is set such that luminance during the period while the liquid-crystal application voltage is maintained positive is equal to luminance during the period while the liquid-crystal application voltage is maintained negative. The common electrode potential thus set is referred to as an optimum counter potential.

The magnitude of the pulldown voltage is different depending on location within the display. The optimum counter potential is also different depending on location within the display. For example, in a large-sized liquid-crystal display apparatus, the gate bus line arranged in the display is very long. The bluntness of the waveform of the scanning signal is largely different between at a location closer to a gate driver outputting the scanning signal and at a location farther from the gate driver. In the large-sized liquid-crystal display apparatus, a non-negligibly large difference may occur between the optimum counter potential at the location closer to the gate driver and the optimum counter potential at the location farther from the gate driver. The optimum counter potential may thus be different depending on location. But it is difficult to differentiate the optimum counter potential depending on location. (For example, it is difficult to differentiate the optimum counter potential from region to region with the display divided into multiple regions). In other words, the potential that may be concurrently applied to the common electrode 73 is only one. In other words, the common electrode potential may be equal to the optimum counter potential in part of the display while the common electrode potential may not be equal to the optimum counter potential in the remaining part of the display. The following discussion focuses on the occurrence of a region where the common electrode potential is not equal to the optimum counter potential.

The pulldown voltage is described in detail below with reference to FIG. 14. The common electrode potential is 0 V herein. The liquid-crystal capacitor Clc has a capacitance value Clc and the parasitic capacitance Cgd has a capacitance value Cgd. The pixel potential is denoted by Vs and the pulldown voltage is denoted by ΔV. According to the law of conservation of charge, in the pixel electrode 72, an amount of charge with the scanning signal at the high level (the gate-on potential Vgh) (namely, the amount of charge with the TFT 71 on) is equal to an amount of charge with the scanning signal at the low level (the gate-off potential Vgl) (namely, the amount of charge with the TFT 71 off). Equation (1) thus holds:

$$Cgd\times(Vs-Vgh)+Clc\times Vs=Cgd\times(Vs-\Delta V-Vgl)+Clc\times(Vs-\Delta V) \quad (1)$$

From Equation (1), Equation (2) is established.

$$\Delta V=\frac{Cgd}{Cgd+Clc}\times(Vgh-Vgl) \quad (2)$$

Ideally, the pulldown voltage ΔV is calculated in accordance with Equation (2). In practice, however, in most of the locations in the display, the value of the pulldown voltage ΔV is different from the value calculated in accordance with Equation (2). This is because the scanning signal is blunted by a wiring resistance and wiring capacitance of the gate bus line GL. As described above, since the bluntness of the scanning signal is different depending on location, the value of the pulldown voltage ΔV is also different depending on location.

FIG. 15 illustrates a configuration example of a display 900 of a liquid-crystal display apparatus of related art. The display 900 has multiple source bus lines SL and m gate bus lines GL (GL1 through GLm). For convenience of explanation, the number of source bus lines SL is 15. Pixel formation regions are arranged near intersection points of the gate bus lines GL and the source bus lines SL. FIG. 15 illustrates pixel formation regions 901 and wiring capacitances 902 of the source bus lines SL. Source shared driving (SSD) may be employed herein. In the SSD, the source bus lines SL are divided into groups in the display 900, each group including two or more source bus lines SL, and the video signal is applied to the two or more source bus lines SL in a time-division manner. Referring to FIG. 15, one group includes a source bus line for red color, a source bus line for green color, and a source bus line for blue color. The source bus line for the red color is denoted by SR with a number. The source bus line for the green color is denoted by SG with a number. The source bus line for the blue color is denoted by SB with a number. For example, one group includes a source bus line SR1, a source bus line SG1, and a source bus line SB1. In the following discussion, the video signal is applied to the bus lines in the order of the source bus line for the red color, the source bus line for the green color, and the source bus line for the blue color during each horizontal scanning period. A gate bus driver 910 applies scanning signals G1 through Gm respectively to gate bus lines GL1 through GLm.

With reference to FIG. 15, the following discussion focuses on a region PA and a region PB. The region PA includes a pixel formation region, closest to the gate bus driver 910, of 15 pixel formation regions connected to the gate bus line GL1 (namely, the pixel formation region arranged for the intersection point of the gate bus line GL1 and the source bus line SR1). The region PB includes a pixel formation region, farthest from the gate bus driver 910, of 15 pixel formation regions (namely, the pixel formation region arranged for the intersection point of the gate bus line GL1 and the source bus line SB5). In this example, the region PA includes the pixel formation region connected to the source bus line SR1 for the red color and the region PB includes the pixel formation region connected to the source bus line SB5 for the blue color.

Referring to FIG. 15, a distance between the gate bus driver 910 and the region PA is relatively short and a distance between the gate bus driver 910 and the region PB is relatively long. The wiring resistance in the region PB is higher than the wiring resistance in the region PA and the wiring capacitance in the region PB is higher than the wiring capacitance in the region PA. For this reason, a time constant that is a product of the wiring resistance and wiring capacitance is larger in the region PB than in the region PA. In view of this, the bluntness of the waveform of the scanning signal is larger in the region PB than in the region PA. G(OUT) represents the scanning signal output from the gate bus driver 910, G(A) represents the scanning signal in the region PA, and G(B) represents the scanning signal in the region PB. The waveforms are illustrated in FIG. 16. FIG. 16 illustrates larger bluntness at the rise and fall of the waveform of the scanning signal in the region PB than in the region PA.

FIG. 17 illustrates a waveform diagram illustrating changes in pixel potential in the region PA and the region PB. Since the SSD is employed, the timing of the application of the video signal to the source bus line SR1 through the region PA is different in practice from the timing of the application of the video signal to the source bus line SB5 through the region PB. For convenience of explanation, FIG. 17 illustrates waveforms based on the assumption that the application of the video signal is performed at the same timing. Referring to FIG. 17, VS represents the video signal applied to the source bus line, VP(A) represents the pixel potential in the region PA, and VP(B) represents the pixel potential in the region PB. VSC represents a center potential of a video signal VS, VPC(A) represents the optimum counter potential in the region PA, and VPC(B) represents the optimum counter potential in the region PB.

When the scanning signal transitions from the low level to the high level in each pixel formation region, the liquid-crystal capacitor Clc is charged in response to the potential of the video signal VS (the video signal VS is written on the liquid-crystal capacitor Clc). The pixel potential in each pixel formation region becomes close to the potential of the video signal VS. When the scanning signal falls later, the pixel potential lowers by the pulldown voltage in each pixel formation region. FIG. 18 is an expansion view of a portion 91 in FIG. 17. The waveforms of the scanning signals G(A) and G(B) in FIG. 18 reveal that the scanning signal falls more gradually in the region PB than in the region PA. Referring to FIG. 18, the pulldown voltage ΔVB in the region PB is thus smaller than the pulldown voltage ΔVA in the region PA. After the fall of the scanning signal, the pixel potential VP(B) in the region PB is higher than the pixel potential VP(A) in the region PA. The discussion herein focuses positive writing. The same is true of negative writing. Referring to FIG. 17, the optimum counter potential VPC(B) in the region PB is higher than the optimum counter potential VPC(A) in the region PA.

FIG. 19 is a waveform diagram illustrating changes in the pixel potentials in view of the SSD. VS(A) represents a potential of the source bus line SR1 in the region PA, VS(B) represents a potential of the source bus line SB5 in the region PB, and SWR, SWG, and SWB respectively represent three switch control signals for the SSD. While the switch control signal SWR remains at the high level, the video signal VS may be applied to the source bus line for the red color. While the switch control signal SWG remains at the high level, the video signal VS may be applied to the source bus line for the green color. While the switch control signal SWB remains at the high level, the video signal VS may be applied to the source bus line for the blue color.

After a scanning signal G1 falls at time t91, the pixel potential VP(B) in the region PB is higher than the pixel potential VP(A) in the region PA. Also, after the scanning signal G1 falls at time t92, the pixel potential VP(B) in the region PB is higher than the pixel potential VP(A) in the region PA. During the positive writing and during the negative writing, the pixel potential VP(B) in the region PB is higher than the pixel potential VP(A) in the region PA.

FIG. 20 is an expansion view of a portion 92 in FIG. 19. VPC(C) represents an optimum counter potential in a portion of center between the region PA and the region PB (hereinafter referred to as a central region). The pulldown voltage becomes smaller as a distance from the gate bus driver 910 increases. The optimum counter potential VPC(A) in the region PA is lower than the optimum counter potential VPC(C) in the central region and the optimum counter potential VPC(B) in the region PB is higher than the optimum counter potential VPC(C) in the central region. Typically, the common electrode potential is set to be equal to the optimum counter potential VPC(C) in the central region. In such a case, the common electrode potential is higher than the optimum counter potential VPC(A) in the region PA and lower than the optimum counter potential VPC(B) in the region PB.

An area where the common electrode potential is not equal to the optimum counter potential is thus created. As a result, flickering, burn-in, variations of luminance (luminance unevenness) may occur. In other words, display quality deteriorates.

Japanese Unexamined Patent Application Publication No. 2019-70770 discloses a technique of controlling a display fault attributed to the above-described phenomena by using multiple liquid-crystal panels. According to the technique, an application voltage to an counter electrode is so set that luminance unevenness, with respect to a portion of a liquid-crystal panel, caused by the application of a voltage to the counter electrode (common electrode) appears in an end portion spaced apart from that portion or in a side portion. In this way, the luminance unevenness does not occur in the center of an image but in a portion spaced apart from the center of the image. The display fault attributed to the luminance unevenness is actually controlled. Japanese Unexamined Patent Application Publication No. 2002-91391 discloses a technique of causing a common electrode potential (counter electrode potential) to be inclined.

According to the technique disclosed in Japanese Unexamined Patent Application Publication No. 2019-70770, luminance unevenness still occurs in a location spaced apart from the center of the image. Specifically, the common electrode potential is not equal to the optimum counter potential in a location spaced apart from the center of the image. For this reason, flickering or burn-in occurs. Depending on the image to be displayed on the display, a location a viewer wants to view may be spaced apart from the center of the image. In such a case, luminance unevenness may occur in a portion of the image the viewer wants to pay attention to. The technique disclosed in Japanese Unexamined Patent Application Publication No. 2002-91391 may have difficulty in differentiating the common electrode potential depending on location.

The present disclosure addresses implementing a liquid-crystal display apparatus that controls, in an entire display, deterioration in display quality attributed to the magnitude of the pulldown voltage that is different depending on location.

SUMMARY

According to an aspect of the disclosure, there is provided a liquid-crystal display apparatus having a display including a plurality of video signal lines, a plurality of scanning signal lines intersecting the video signal lines, and a plurality of pixel formation regions that are arranged at intersection points where the video signal lines and the scanning signal lines intersect each other, the liquid-crystal display apparatus including: a video signal line driving circuit that applies a video signal to the video signal lines; a scanning signal line driving circuit that applies a scanning signal to the scanning signal lines; a common electrode that is supplied with a constant potential; and a plurality of adjustment capacitors that respectively correspond to the video signal lines on a one-to-one correspondence basis; wherein each of the pixel formation regions includes: a pixel electrode; a pixel transistor that includes a control terminal connected to a corresponding scanning signal line, a first conductive terminal connected to a corresponding video signal line, and a second conductive terminal connected to the pixel electrode; and a liquid-crystal capacitor that is created by the pixel electrode and the common electrode, wherein each of the adjustment capacitors includes: a first electrode; and a second electrode connected to a corresponding video signal line, and wherein a potential of the first electrode is raised after the liquid-crystal capacitor is charged with the video signal applied to the video signal line corresponding to the pixel formation region including the pixel transistor that transitions into an on-state in response to a rise of the scanning signal caused by the scanning signal driving circuit and before the scanning signal line driving circuit causes the scanning signal to fall.

According to an aspect of the disclosure, there is provided a driving method of a liquid-crystal display apparatus having a display including a plurality of video signal lines, a plurality of scanning signal lines intersecting the video signal lines, and a plurality of pixel formation regions that are arranged at intersection points where the video signal lines and the scanning signal lines intersect each other, the liquid-crystal display apparatus including: a common electrode that is supplied with a constant potential; and a plurality of adjustment capacitors that respectively correspond to the video signal lines on a one-to-one correspondence basis; wherein each of the pixel formation regions includes: a pixel electrode; a pixel transistor that includes a control terminal connected to a corresponding scanning signal line, a first conductive terminal connected to a corresponding video signal line, and a second conductive terminal connected to the pixel electrode; and a liquid-crystal capacitor that is created by the pixel electrode and the common electrode, wherein each of the adjustment capacitor includes: a first electrode; and a second electrode connected to a corresponding video signal line, the driving method including: causing a scanning signal applied to one of the scanning lines to rise; with the scanning signal maintained at a rise state, charging the liquid-crystal capacitor in accordance with the video signal applied to each video signal line; raising a potential of the first electrode such that the liquid-crystal capacitor is overcharged with the potential of the video signal raised; and causing the scanning signal to fall.

DESCRIPTION OF THE EMBODIMENTS

Embodiments of the disclosure are described with reference to the drawings. Description of elements in second and third embodiments identical to those in a first embodiment are not repeated.

1. First Embodiment

1.1 Whole Configuration and Summary of Operation of First Embodiment

Figure 2:
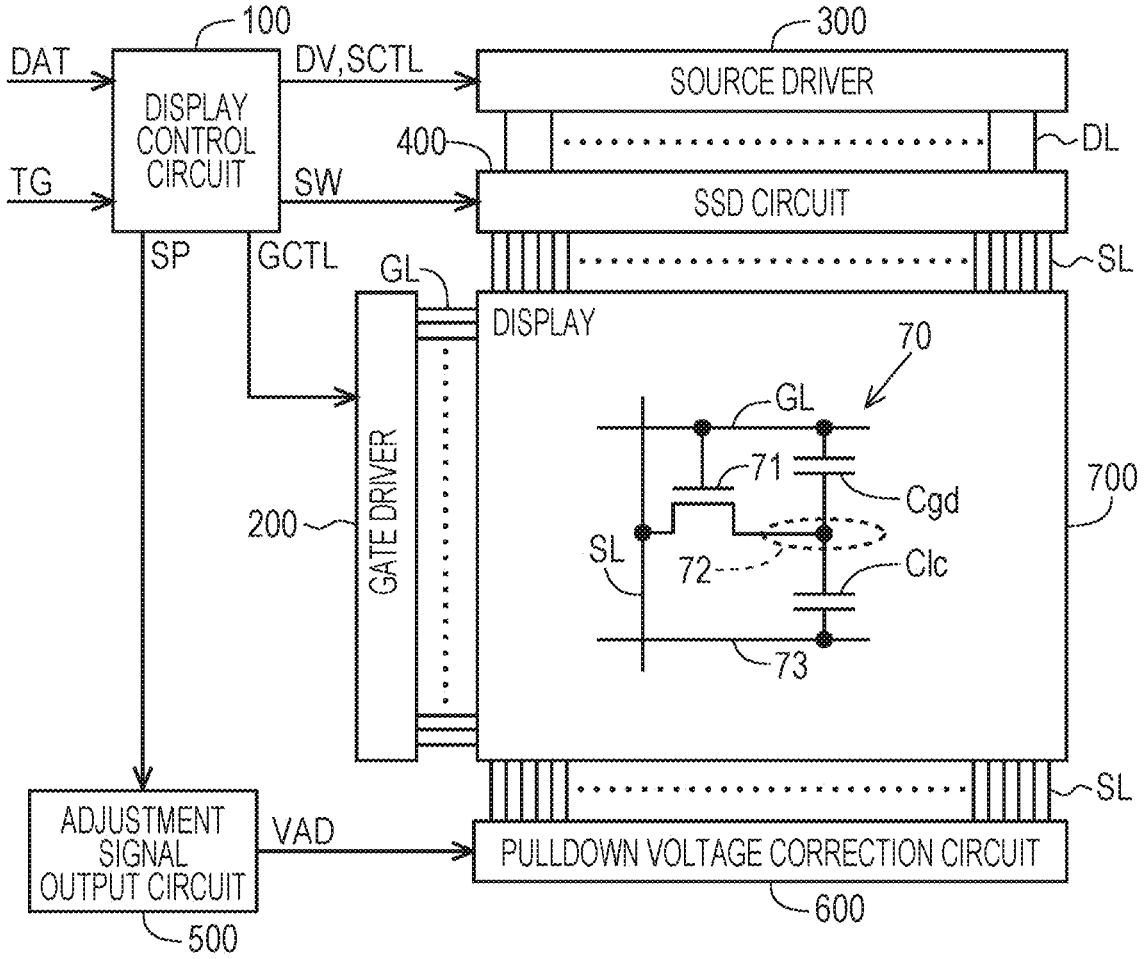
FIG. 2 is a block diagram illustrating a whole configuration of an active-matrix liquid-crystal display apparatus of the first embodiment.

FIG. 2 is a block diagram illustrating a whole configuration of an active-matrix liquid-crystal display apparatus of the first embodiment. Referring to FIG. 2, the liquid-crystal display apparatus includes a display control circuit 100, a gate driver (scanning signal line driving circuit) 200, a source driver (video signal line driving circuit) 300, a source shared driving (SSD) circuit 400, an adjustment signal output circuit 500, a pulldown voltage correction circuit 600, and a display 700.

The display 700 includes multiple source bus lines (video signal lines) SL and multiple gate bus lines (scanning signal lines) GL. A pixel formation region 70 is arranged at each of intersection points where the source bus lines SL and the gate bus lines GL intersect each other. The display 700 thus includes multiple pixel formation regions 70. According to the first embodiment, one pixel is formed of the pixel formation region 70 for the red color, the pixel formation region 70 for the green color, and the pixel formation region 70 for the blue color. Each pixel formation region 70 includes a pixel thin-film transistor (TFT) 71, a pixel electrode 72, a common electrode 73, and a liquid-crystal capacitor Clc. The TFT 71 has a gate terminal (control terminal) connected to the gate bus line GL passing through a corresponding intersection point and a source terminal (first conductive terminal) connected to a source bus line SL passing through the intersection point. The pixel electrode 72 is connected to a drain terminal (second conductive terminal) of the TFT 71. The common electrode 73 serving as a counter electrode is commonly shared by the pixel formation regions 70 and supplied with a constant potential. The liquid-crystal capacitor Clc is created by the pixel electrode 72 and the common electrode 73. The parasitic capacitance Cgd is present between the pixel electrode 72 and the gate bus line GL. FIG. 2 illustrates only one pixel formation region 70.

The gate bus lines GL are connected to the gate driver 200. The source bus lines SL are connected to the SSD circuit 400. The SSD circuit 400 is connected to the source driver 300 via data output lines DL. According to the first embodiment, the number of data output lines DL is one third the number of source bus lines SL.

The display control circuit 100 receives, from the outside, an image signal DAT and timing signal groups TG, such as a horizontal synchronization signal and a vertical synchronization signal. The display control circuit 100 then outputs a digital video signal DV, a gate control signal GCTL used to control the operation of the gate driver 200, a source control signal SCTL used to control the source driver 300, a switch control signal SW used to control the operation of the SSD circuit 400, and a potential variation control signal SP used to control the operation of the adjustment signal output circuit 500. The gate control signal GCTL includes a gate start pulse signal and a gate clock signal. The source control signal SCTL includes a source start pulse signal, a source clock signal, and a latch strobe signal.

In response to the gate control signal GCTL received from the display control circuit 100, the gate driver 200 repeats the application of an active scanning signal to each gate bus line GL every vertical scanning period.

In response to the digital video signal DV and the source control signal SCTL received from the display control circuit 100, the source driver 300 outputs every horizontal scanning period a driving video signal in a time-division manner to the data output lines SL corresponding to a group (source bus line group), into which the source bus lines SL are divided. For example, one group is formed of three source bus lines SL. At the timing when the pulse of the source clock signal is generated, the source driver 300 successively holds the digital video signal DV indicative of a voltage that is to be applied to each data output line DL. At the timing when the pulse of the latch strobe signal is generated, the held digital video signal DV is converted to an analog voltage. The analog voltage as a result of conversion is applied at once to all the data output lines DL as the driving video signal.

In response to the switch control signal SW received from the display control circuit 100, the SSD circuit 400 provides the video signal received from the source driver 300 via each data output line DL to one of a corresponding three source bus lines SL.

The adjustment signal output circuit 500 outputs an adjustment output signal VAD that is to be provided to the pulldown voltage correction circuit 600. The adjustment signal output circuit 500 varies the potential of the adjustment output signal VAD in accordance with the potential variation control signal SP received from the display control circuit 100. In response to the adjustment output signal VAD received from the adjustment signal output circuit 500, the pulldown voltage correction circuit 600 controls the potential of each source bus line SL immediately before the fall of scanning signal such that the pulldown voltage at the fall of the scanning signal in each pixel formation region 70 is cancelled. The adjustment output signal VAD and the pulldown voltage correction circuit 600 are described in greater detail below.

As described above, the video signal VS is applied to the source bus line SL and the scanning signal is applied to the gate bus line GL. An image responsive to the image data DAT received from the outside is displayed on the display 700. The potential of the source bus line SL is controlled by the pulldown voltage correction circuit 600 such that the pulldown voltage is cancelled in each pixel formation region 70. Display quality deterioration may thus be controlled.

1.2 SSD Circuit

Figure 3:
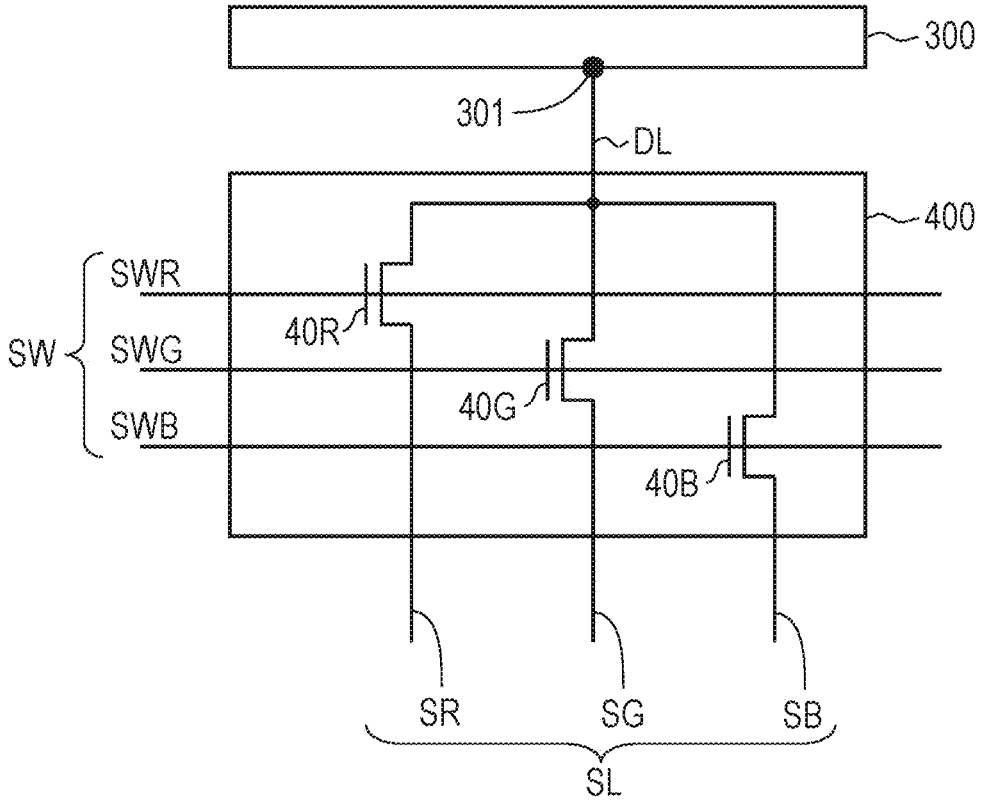
FIG. 3 is a circuit diagram of a source shared driving (SSD) circuit in the first embodiment.

FIG. 3 is a circuit diagram illustrating the configuration of the SSD circuit 400 in the first embodiment. According to the first embodiment, concerning the driving of the source bus line SL, three source bus lines SL, including one source bus line SR for the red color, one source bus line SG for the green color, and one source bus line SB for the blue color, serves as one driving unit. FIG. 3 illustrates elements for one driving unit. Referring to FIG. 3, one output terminal 301 (output terminal outputting the video signal VS) of the source driver 300 is illustrated.

The SSD circuit 400 receives, as the switch control signals SW, the switch control signal SWR for the red color, the switch control signal SWG for the green color, and the switch control signal SWB for the blue color. The SSD circuit 400 includes a TFT 40R used to control an electrical connection state between an output terminal 301 of the source driver 300 and the source bus line SR for the red color, a TFT 40G used to control an electrical connection state between the output terminal 301 and the source bus line SG for the green color, and a TFT 40B used to control an electrical connection state between the output terminal 301 and the source bus line SB for the blue color. The TFT 40R, TFT 40G, and TFT 40B are n-channel TFTs. The TFT 40R has a gate terminal supplied with the switch control signal SWR, a drain terminal connected to the output terminal 301 via the data output line DL, and a source terminal connected to the source bus line SR for the red color. The TFT 40G has a gate terminal supplied with the switch control signal SWG, a drain terminal connected to the output terminal 301 via the data output line DL, and a source terminal connected to the source bus line SG for the green color. The TFT 40B has a gate terminal supplied with the switch control signal SWB, a drain terminal connected to the output terminal 301 via the data output line DL, and a source terminal connected to the source bus line SB for the blue color.

In the configuration described above, when the video signal VS is to be applied to the source bus line SR for the red color, the display control circuit 100 transitions the switch control signal SWR to the high level and the switch control signal SWG and the switch control signal SWB to the low level. In this way, the TFT 40R is transitioned to the on-state while the TFT 40G and the TFT 40B are transitioned to the off-state. The data output line DL is thus electrically connected to the source bus line SR for the red color. When the video signal VS is to be applied to the source bus line SG for the green color, the display control circuit 100 transitions the switch control signal SWG to the high level and the switch control signal SWR and the switch control signal SWB to the low level. In this way, the TFT 40G is transitioned to the on-state while the TFT 40R and the TFT 40B are transitioned to the off-state. The data output line DL is thus electrically connected to the source bus line SG for the green color. When the video signal VS is to be applied to the source bus line SB for the blue color, the display control circuit 100 transitions the switch control signal SWB to the high level and the switch control signal SWR and the switch control signal SWG to the low level. In this way, the TFT 40B is transitioned to the on-state while the TFT 40R and the TFT 40G are transitioned to the off-state. The data output line DL is thus electrically connected to the source bus line SB for the blue color. In response to the switch control signals SWR, SWG, and SWB, the TFT 40R, TFT 40G, and TFT 40B are successively turned on for a specific period of time within each horizontal scanning period.

As described above, the SSD circuit 400 of the first embodiment successively turns on the three TFTs (the TFT 40R, TFT 40G, and TFT 40B) for the specific period of time every horizontal scanning period. The SSD circuit 400 thus switches the three source bus lines SL from one to another in a time-division manner as the connection destination of each output terminal of the source driver 300.

According to the first embodiment, the SSD circuit 400 implements a connection switch circuit and the TFT 40R, TFT 40G, and TFT 40B respectively implement three connection control transistors.

According to the first embodiment, one pixel is formed of the pixel formation region 70 for the red color, the pixel formation region 70 for the green color, and the pixel formation region 70 for the blue color. The SSD circuit 400 switches accordingly the three source bus lines SL to be connected to the connection destination of each output terminal 301 of the source driver 300 in a time-division manner. The disclosure is not limited to this method. For example, N may be two or greater integer and the SSD circuit 400 may switch the N source bus lines SL to be connected to the connection destination of each output terminal 301 of the source driver 300 in a time-division manner.

1.3 Pulldown Voltage Correction Circuit

Figure 15:
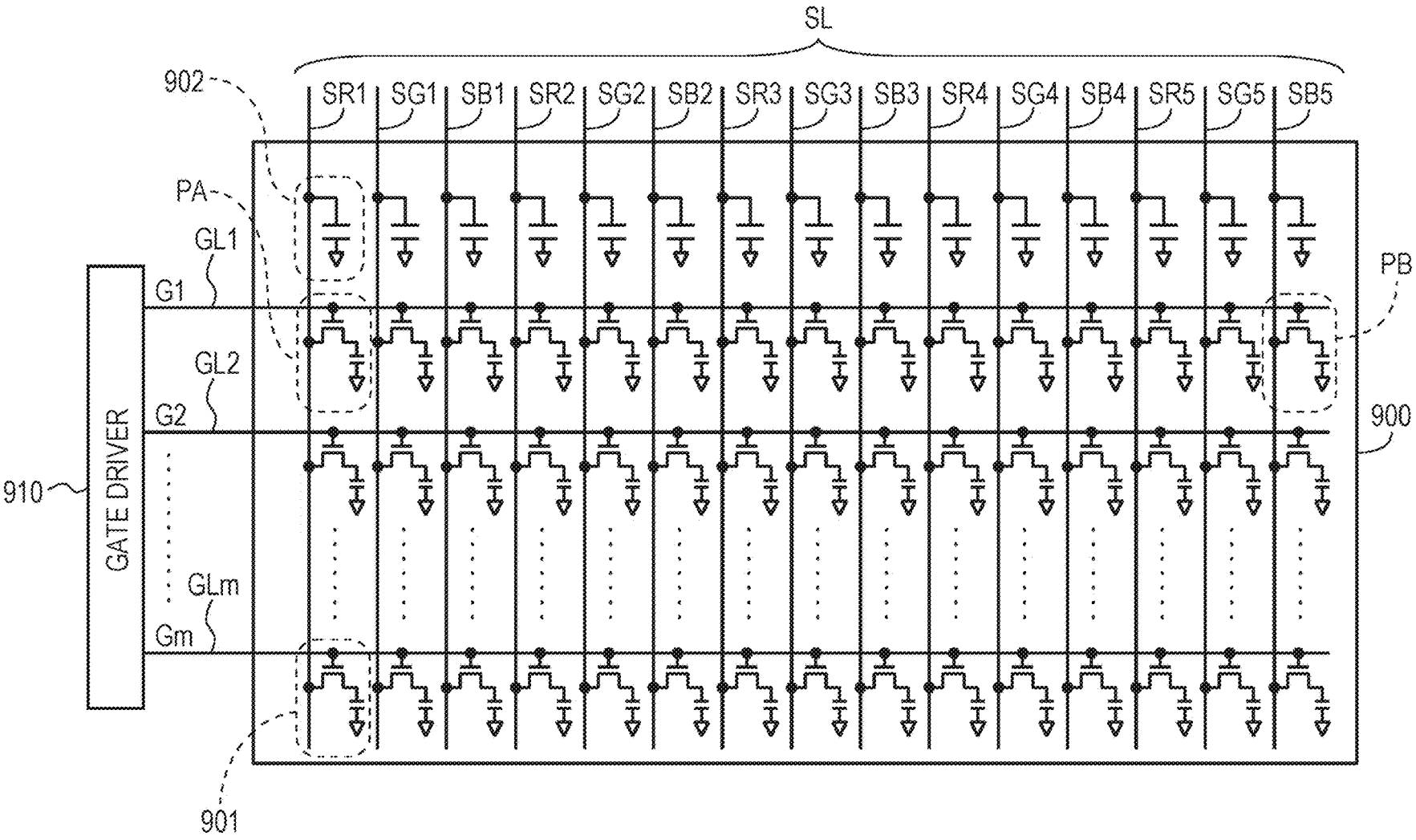
FIG. 15 illustrates a configuration of a liquid-crystal display apparatus of related art.

The configuration of the pulldown voltage correction circuit 600 of the first embodiment is described with reference to FIG. 1. Like the configuration illustrated in FIG. 15, the display 700 includes 15 source bus lines SL (five source bus lines SR1 through SR5 for the red color, five source bus line SG1 through SG5 for the green color, and five source bus lines SB1 through SB5 for the blue color (the same is true of the second embodiment and the third embodiment).

The pulldown voltage correction circuit 600 includes 15 capacitors (hereinafter referred to as adjustment capacitors) that correspond to the 15 source bus lines SL on a one-to-one correspondence basis. Each adjustment capacitor includes a first electrode supplied with the adjustment output signal VAD and a second electrode connected to a corresponding source bus line SL. The adjustment capacitor arranged for the source bus line for the red color is denoted by "CR" followed by a number, the adjustment capacitor arranged for the source bus line for the green color is denoted by "CG" followed by a number and the adjustment capacitor arranged for the source bus line for the blue color is denoted by "CB" followed by a number. For example, the adjustment capacitor corresponding to the source bus line SR3 for the red color is denoted by CR3. Parenthesized reference symbol attached to the adjustment capacitor signifies a capacitance value of each adjustment capacitor. If two or more adjustment capacitors have the same parenthesized reference symbol, the adjustment capacitors have the same capacitance value and if two or more adjustment capacitors have different parenthesized reference symbols, the adjustment capacitors have different capacitance values.

Figure 1:
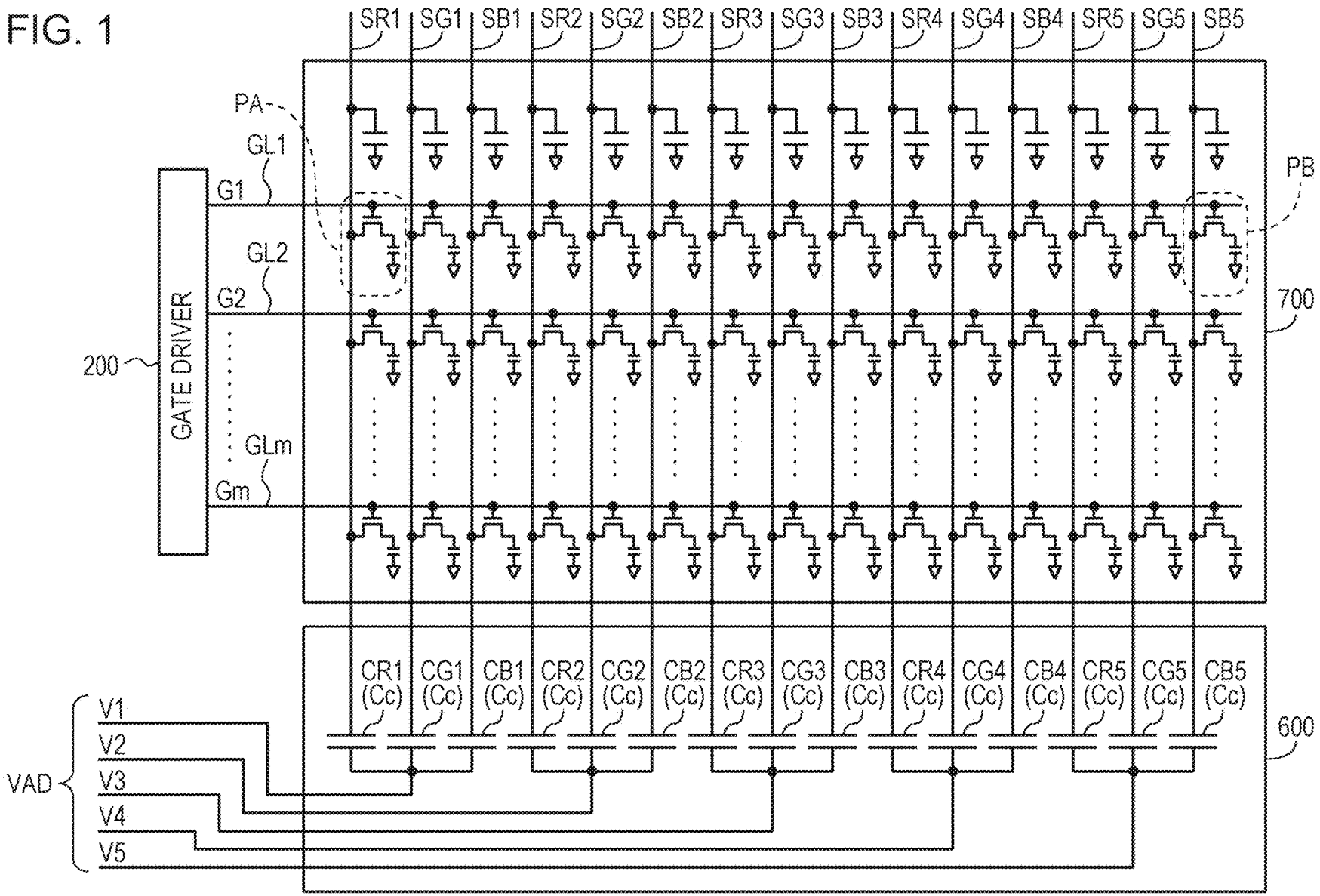
FIG. 1 illustrates a configuration of a pulldown voltage correction circuit in a first embodiment.

As illustrated in FIG. 1, the capacitance values of the 15 adjustment capacitors are equal to each other in the pulldown voltage correction circuit 600 in the first embodiment. The pulldown voltage correction circuit 600 is supplied with first through fifth adjustment signals V1 through V5 as the adjustment output signals VAD. According to the first embodiment, the first electrodes of the adjustment capacitors CR1, CG1, and CB1 are supplied with the first adjustment signal V1, the first electrodes of the adjustment capacitors CR2, CG2, and CB2 are supplied with the second adjustment signal V2, the first electrodes of the adjustment capacitors CR3, CG3, and CB3 are supplied with the third adjustment signal V3, the first electrodes of the adjustment capacitors CR4, CG4, and CB4 are supplied with the fourth adjustment signal V4, and the first electrodes of the adjustment capacitors CR5, CG5, and CB5 are supplied with the fifth adjustment signal V5.

Figure 4:
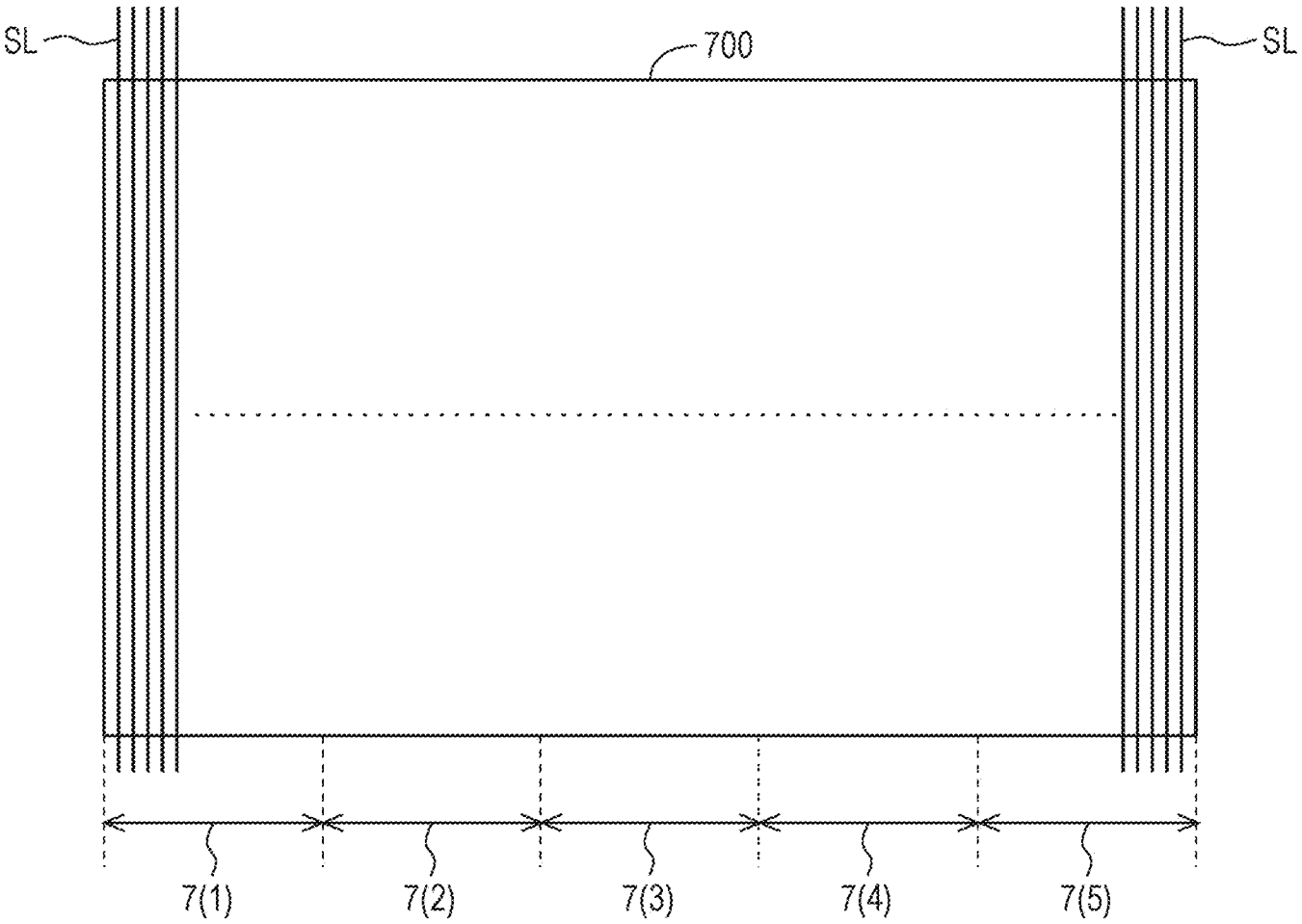
FIG. 4 illustrates how an adjustment signal is provided to the pulldown voltage correction circuit in the first embodiment when multiple bus lines are arranged in a display.

The number of source bus lines SL arranged in the display 700 is 15. In practice, however, a large number of source bus lines SL are arranged in the display 700. A large number of adjustment capacitors are arranged accordingly in the pulldown voltage correction circuit 600. The whole display 700 is logically divided into multiple blocks and the large number of adjustment capacitors are divided into multiple groups that correspond to the blocks on a one-to-one correspondence basis. The pulldown voltage correction circuit 600 is supplied with multiple adjustment output signals VAD that respectively correspond to the groups on a one-to-one correspondence basis. The first electrodes of the adjustment capacitors forming each group are supplied with a corresponding adjustment signal VAD. For example, as illustrated in FIG. 4, the while display 700 is divided into five blocks, namely, block 7(1) through 7(5) and the number of adjustment capacitors in the pulldown voltage correction circuit 600 are divided into five groups respectively for the blocks 7(1) through 7(5) on a one-to-one correspondence basis. The pulldown voltage correction circuit 600 is supplied with the first through fifth adjustment signals V1 through V5 as the adjustment output signals VAD. The first electrodes of the adjustment capacitors forming the group corresponding to the block 7(1) is supplied with the first adjustment signal V1, the first electrodes of the adjustment capacitors forming the group corresponding to the block 7(2) is supplied with the second adjustment signal V2, the first electrodes of the adjustment capacitors forming the group corresponding to the block 7(3) is supplied with the third adjustment signal V3, the first electrodes of the adjustment capacitors forming the group corresponding to the block 7(4) is supplied with the fourth adjustment signal V4, and the first electrodes of the adjustment capacitors forming the group corresponding to the block 7(5) is supplied with the fifth adjustment signal V5. Referring to FIG. 1, one group is formed of three adjustment capacitors.

1.4 Operation

Figure 6:
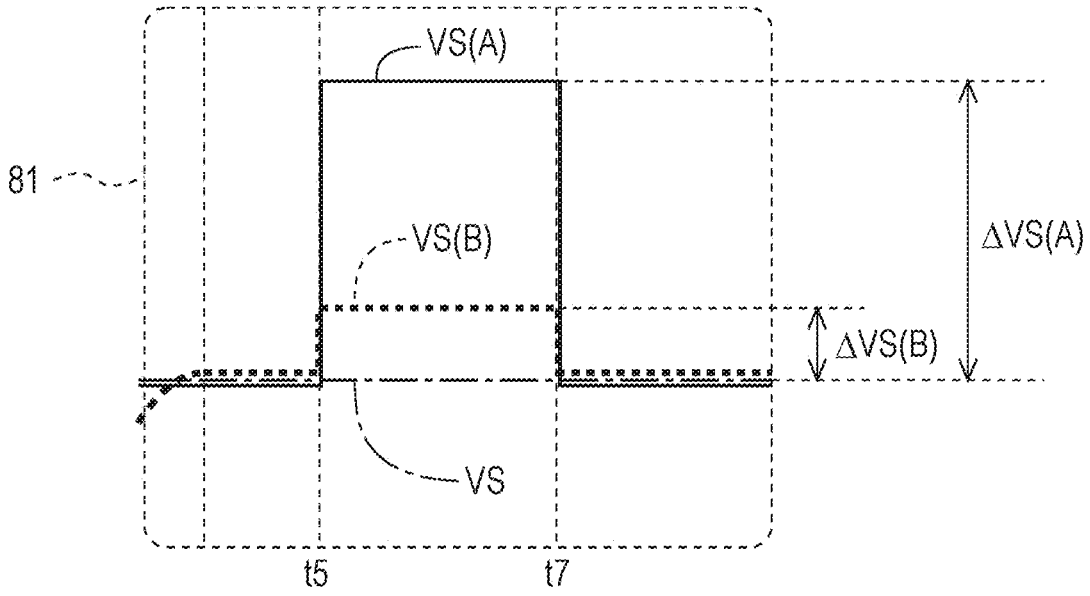
FIG. 6 illustrates an expansion view of a portion in FIG. 5.
Figure 7:
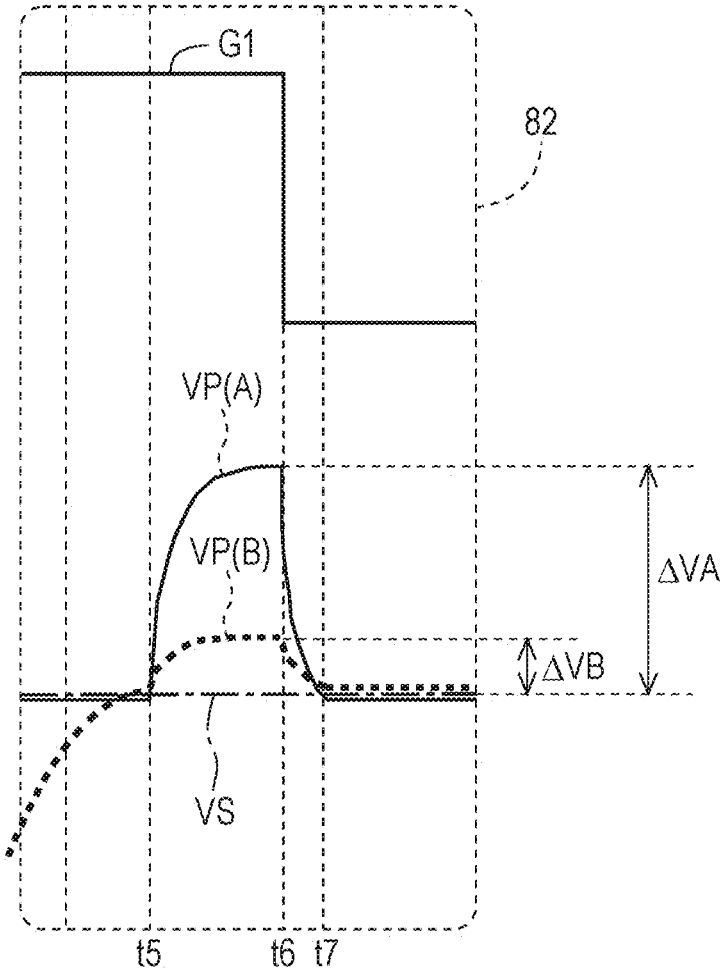
FIG. 7 illustrates an expansion view of a portion in FIG. 5.

The operation of the first embodiment is described with reference to FIGS. 5, 6, and 7. FIG. 6 is an expansion view of a portion 81 in FIG. 5. FIG. 7 is an expansion view of a portion 82 in FIG. 5. The discussion herein focuses on the region PA and the region PB (see FIG. 1). The discussion herein also focuses on a horizontal scanning period at which the scanning signal G1 applied to the gate bus line GL1 rises. The same operation is also performed during another horizontal scanning period.

When the scanning signal G1 rises at time t1, the TFTs 71 transition from the off-state to the on-state in the region PA and the region PB.

When the switch control signal SWR transitions from the low level to the high level at time t2, the source bus line SR1 is charged in accordance with the video signal VS. The TFT 71 is in the on-state in the region PA. For this reason, in the region PA, the liquid-crystal capacitor Clc is charged in response to a charging voltage of the source bus line SR1 in the region PA and the pixel potential VP(A) approaches the potential of the video signal VS. When the switch control signal SWR transitions from the high level to the low level, the source bus line SR1 becomes floating.

When the switch control signal SWB transitions from the low level to the high level at time t3, the source bus line SB5 is charged in response to the video signal VS. The TFT 71 is then in the on-state in the region PB. For this reason, the liquid-crystal capacitor Clc is charged with the charging voltage of the source bus line SB5 and the pixel potential VP(B) approaches the potential of the video signal VS. When the switch control signal SWB transitions from the high level to the low level at time t4, the source bus line SB5 becomes floating.

Figure 5:
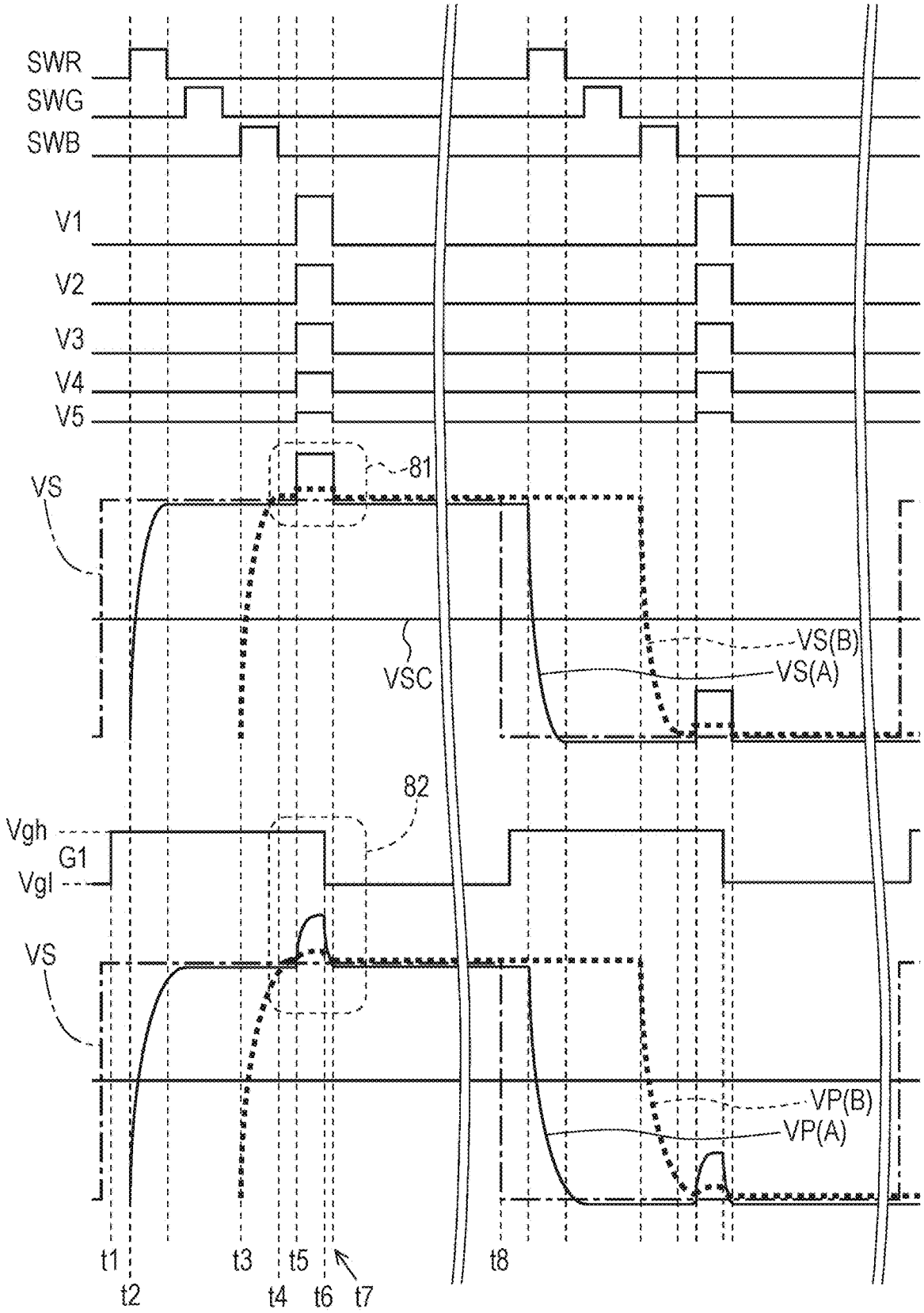
FIG. 5 is a waveform diagram that describes an operation of the first embodiment.

At time t5, the potentials of the first through fifth adjustment signals V1 through V5 rise as illustrated in FIG. 5. The degree of rising of the potential of the adjustment signal becomes larger as the corresponding source bus line SL is closer to the gate driver 200. Specifically, let V1*pp* through V5*pp* represent amplitudes of the first through fifth adjustment signals V1 through V5 (amount of changes in potential), and the first through fifth adjustment signals V1 through V5 respectively rise in a manner that satisfy the relationship "V1*pp*>V2*pp*>V3*pp*>V4*pp*>V5*pp*." According to the first embodiment, each of the amplitudes V1*pp* through V5*pp* is larger as the distance between the source bus line SL connected to the second electrode forming a corresponding group and the gate driver 200 is shorter.

Referring to FIGS. 3 and 5, after the latest-turned-on one of the three TFTs (the TFT 40R, TFT 40G, and TFT 40B) in the SSD circuit 400 transitions from the on-state to the off-state, the adjustment signal output circuit 500 raises the potentials of the first electrodes by raising the potentials of the first through fifth adjustment signals V1 through V5.

As the potential of the first adjustment signal V1 rises, the potential VS(A) of the source bus line SR1 rises via the adjustment capacitor CR1, and as the potential of the fifth adjustment signal V5 rises, the potential VS(B) of the source bus line SB5 rises via the adjustment capacitor CB5 (see FIG. 6). Let CbusR1 represent a wiring capacitance of the source bus line SR1 and let CbusB5 represent a wiring capacitance of the source bus line SB5, and an amount of change ΔVS(A) of the potential VS(A) of the source bus line SR1 is expressed by Equation (3), and an amount of change ΔVS(B) of the potential VS(B) of the source bus line SB5 is expressed by Equation (4):

$$\Delta VS(A) = \frac{Cc}{Cc + C\,\text{bus}\,R1} \times V1pp \tag{3}$$

$$\Delta VS(B) = \frac{Cc}{Cc + C\,\text{bus}\,B5} \times V5pp \tag{4}$$

In Equations (3) and (4), the wiring capacitance CbusR1 of the source bus line SR1 is nearly equal to the wiring capacitance CbusB5 of the source bus line SB5. As described above, the amplitude V1*pp* of the first adjustment signal V1 is larger than the amplitude V5*pp* of the fifth adjustment signal V5. Referring to FIG. 6, the amount of change ΔVS(A) of the potential VS(A) of the source bus line SR1 is larger than the amount of change ΔVS(B) of the potential VS(B) of the source bus line SB5.

Since the scanning signal G1 is at the high level at time t5, the TFTs 71 are in the on-state in the region PA and the region PB. The pixel potential VP(A) in the region PA rises as the potential VS(A) of the source bus line SR1 rises and the pixel potential VP(B) in the region PB rises as the potential VS(B) of the source bus line SB5 rises (see FIG. 7). With reference to FIG. 7, the pixel potential VP(A) in the region PA is substantially higher than the pixel potential VP(B) in the region PB immediately before the scanning signal G1 falls.

Figure 16:
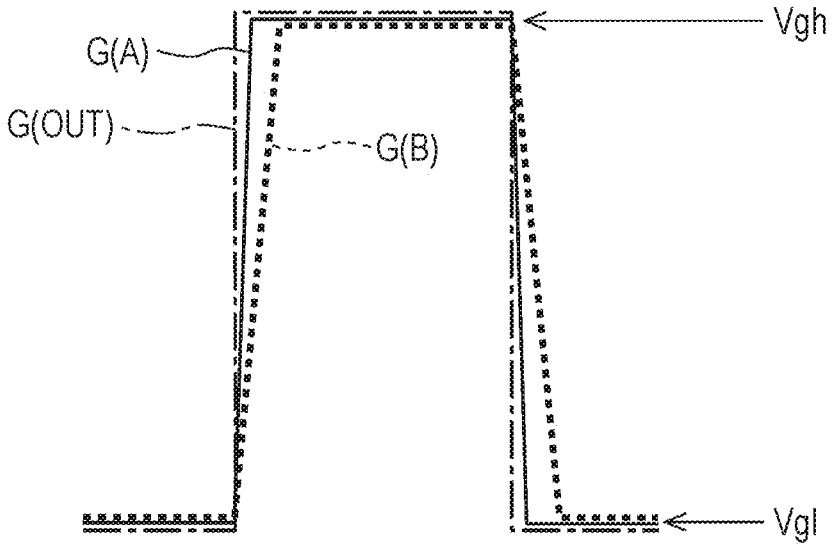
FIG. 16 is a waveform diagram illustrating bluntness of a waveform of a scanning signal.
Figure 17:
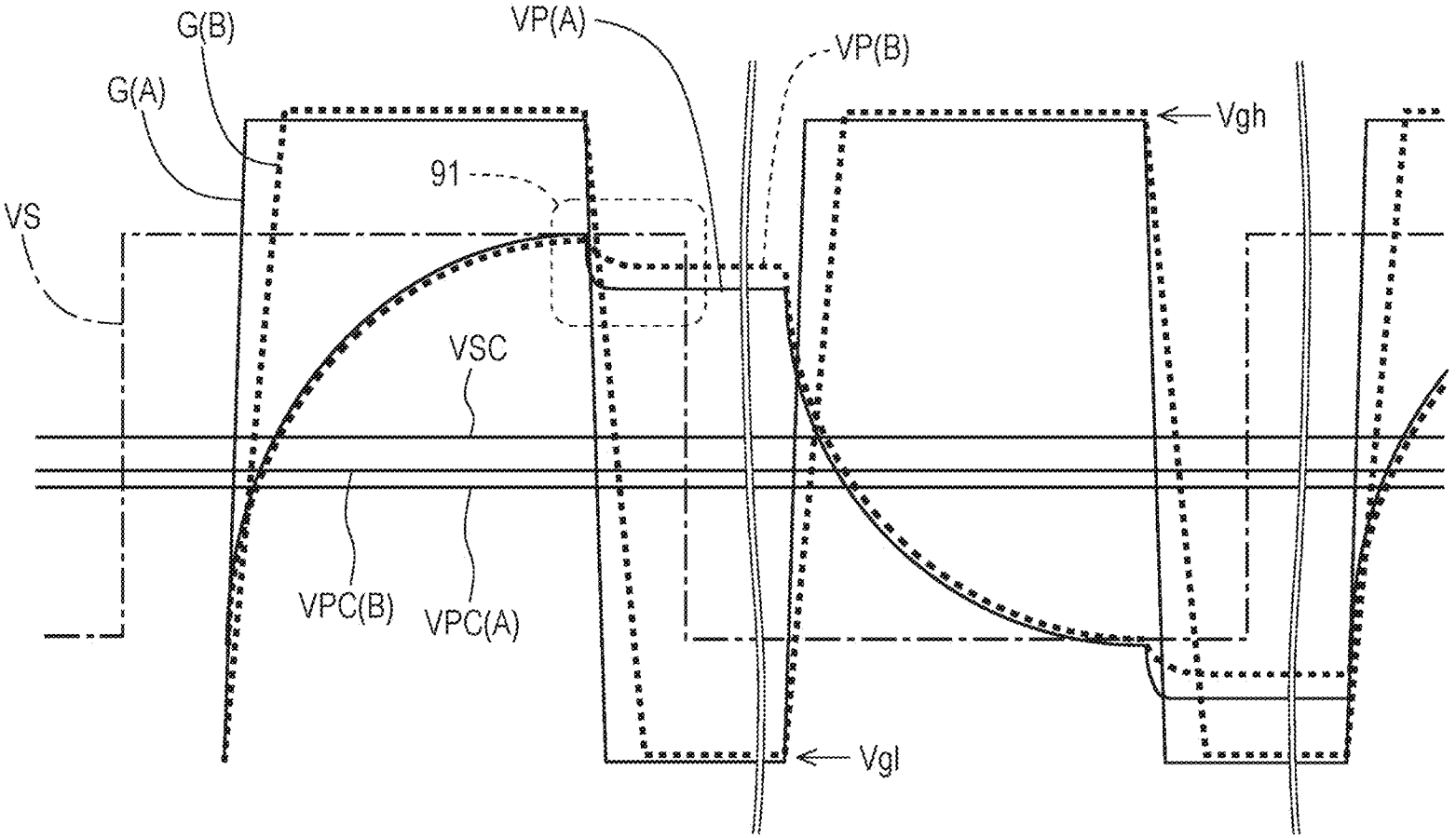
FIG. 17 is a waveform diagram illustrating a change in a pixel potential in the related art.
Figure 18:
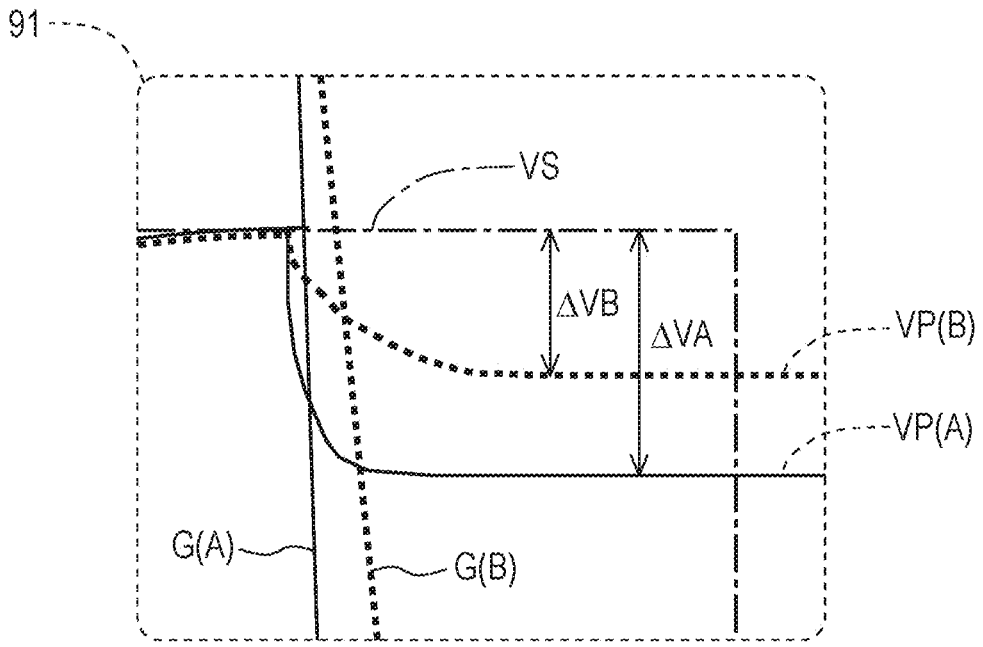
FIG. 18 is an expansion view of a portion in FIG. 17.
Figure 19:
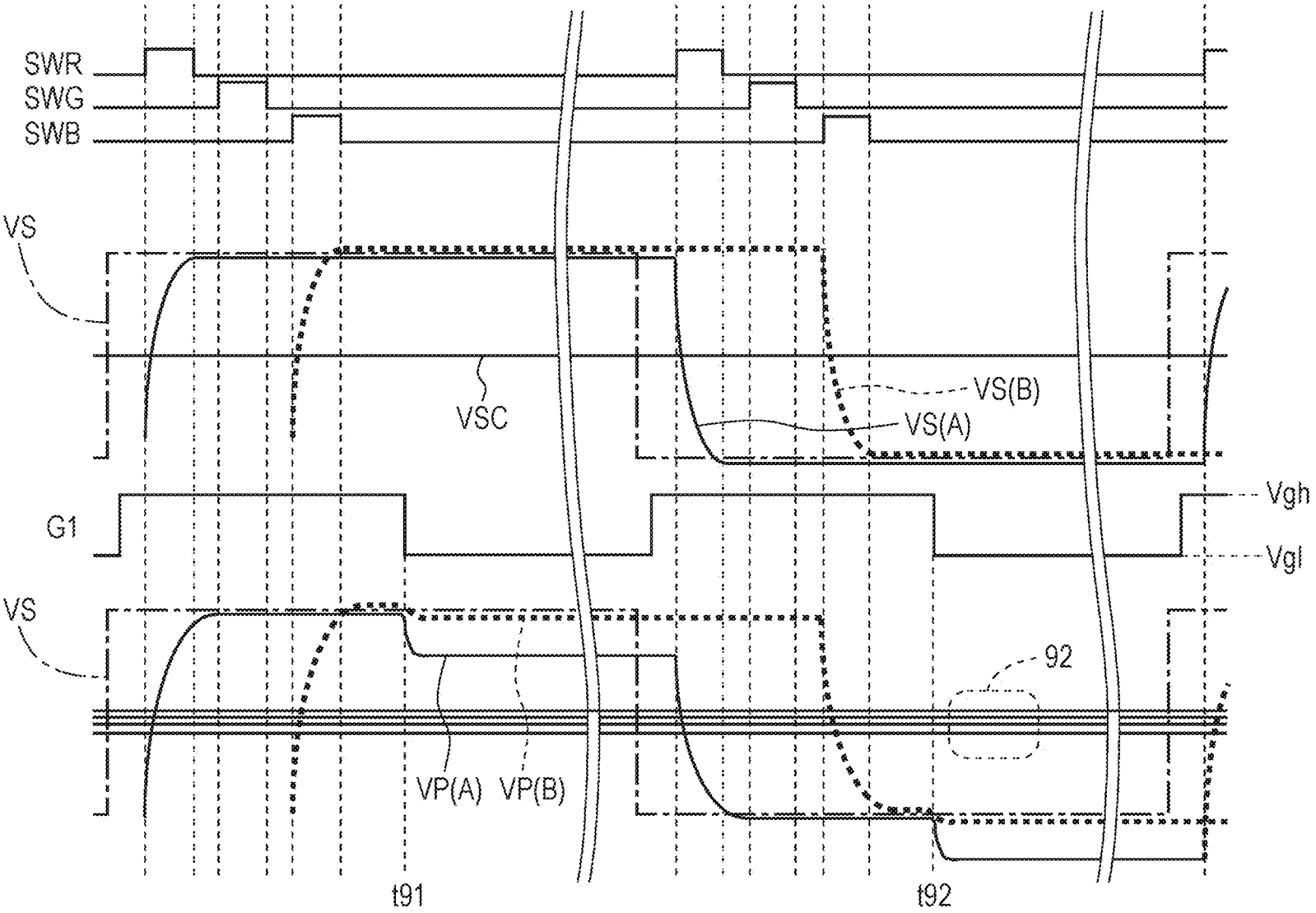
FIG. 19 is a waveform diagram illustrating a change in the pixel potential in view of the SSD in the related art.
Figure 20:
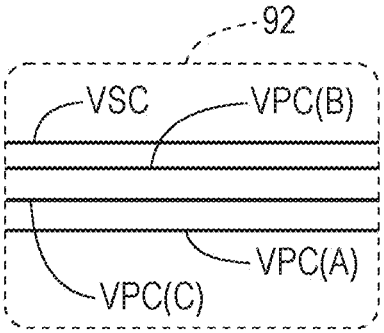
FIG. 20 is an expansion view of a portion in FIG. 19.

The scanning signal G1 falls at time t6 and the TFTs 71 transition from the on-state to the off-state in the region PA and the region PB. The pixel potential lowers by the pulldown voltage in the region PA and the region PB. Since a larger bluntness occurs in the waveform of the scanning signal in the region PB than in the region PA as illustrated in FIG. 16, the pulldown voltage ΔVB in the region PB becomes substantially smaller than the pulldown voltage ΔVA in the region PA (see FIG. 7). The lowered pixel potential is kept in the region PA and the region PB until the writing of a next video signal VS starts.

As described above, the pixel potential rises as the potential of the adjustment signal VAD rises immediately before the fall of the scanning signal G1, and the pixel potential lowers by the pulldown voltage at the fall of the scanning signal G1. The pulldown voltage ΔVA in the region PA at the fall of the scanning signal G1 may be cancelled by adjusting the amplitude V1*pp* of the first adjustment signal V1 in a manner such that the amount of change ΔVS(A) of the potential VS(A) of the source bus line SR1 responsive to the rise of the potential of the first adjustment signal V1 is equal to the pulldown voltage ΔVA in the region PA. Also, the pulldown voltage ΔVB in the region PB at the fall of the scanning signal G1 may be cancelled by adjusting the amplitude V5*pp* of the fifth adjustment signal V5 in a manner such that the amount of change ΔVS(B) of the potential VS(B) of the source bus line SB5 responsive to the rise of the potential of the fifth adjustment signal V5 is equal to the pulldown voltage ΔVB in the region PB. In the same way as described above, the amplitudes V2*pp* through V4*pp* of the second adjustment signal V2 through the fourth adjustment signal V4 are adjusted and the pulldown voltage in regions other than the region PA and the region PB may also be cancelled.

At time t7, the potentials of the first adjustment signal V1 through the fifth adjustment signal V5 lower to potentials immediately before time t5. In this way, the potential VS(A) of the source bus line SR1 and the potential VS(B) of the source bus line SB5 also lower to potentials immediately before time t5. The TFTs 71 in the region PA and the region PB are then in the off-state. No change thus occurs in the pixel potentials in the region PA and the region PB.

At time t8, the polarity of the video signal VS transitions from positive to negative. In the negative writing as in the positive writing, the pixel potential rises as the potential of the adjustment signal rises immediately before the fall of the scanning signal G1, and the pixel potential lowers by the pulldown voltage at the fall of the scanning signal G1. In this way, when the negative writing is performed, the pulldown voltage is cancelled in each pixel formation region 70 at the fall of the scanning signal.

As described above, the pixel potential of the first electrode of each adjustment capacitor is raised after the liquid-crystal capacitor Clc is charged in response to the video signal applied to the corresponding source bus line SL in the pixel formation region 70 including the TFT 71 that is in the on-state with the gate driver 200 causing the scanning signal to rise and before the gate driver 200 causes the scanning signal to fall.

The rising of the scanning signal is performed in response to the operation carried out at time t1, the liquid-crystal capacitor charging is performed in response to the operation carried out from time t2 to time t4, the overcharging may be performed in the operation carried out from time t5 to time t6, and the scanning signal falling is performed in response to the operation carried out at time t6.

1.5 Determination Method of Amplitude of Adjustment Signal (Adjustment Method)

A determination method (adjustment method) of the amplitudes V1*pp* through V5*pp* of the first adjustment signal V1 through the fifth adjustment signal V5 is described below. The amplitudes V1*pp* through V5*pp* of the first adjustment signal V1 through the fifth adjustment signal V5 are determined before the start of the volume production of the liquid-crystal panels forming the liquid-crystal display apparatuses. When liquid-crystal panels are produced in volume, there are few individual differences (variations) in finished products in general. Specifically, a difference in the pulldown voltage between the corresponding regions of the multiple liquid-crystal panels is smaller than a difference in the pulldown voltage between regions in a single liquid-crystal panel (for example, a difference between the pulldown voltage ΔVA in the region PA and the pulldown voltage ΔVB in the region PB). Typical differences (absolute values herein) Δpp1, Δpp2, Δpp4, and Δpp5 are determined between the amplitude V3*pp* of the third adjustment signal V3 and each of the amplitude V1*pp* of the first adjustment signal V1, the amplitude V2*pp* of the second adjustment signal V2, the amplitude V4*pp* of the fourth adjustment signal V4, and the amplitude V5*pp* of the fifth adjustment signal V5. The amplitude V3*pp* of the third adjustment signal V3 is determined in view of a display state of an image and a flickering value of the image in the central region of the display 700. The amplitude V1*pp* of the first adjustment signal V1, the amplitude V2*pp* of the second adjustment signal V2, the amplitude V4*pp* of the fourth adjustment signal V4, and the amplitude V5*pp* of the fifth adjustment signal V5 are respectively determined in accordance with Equations (5) through (8):

$$V1pp=V3pp+\Delta pp1 \tag{5}$$

$$V2pp=V3pp+\Delta pp2 \tag{6}$$

$$V4pp=V3pp-\Delta pp4 \tag{7}$$

$$V5pp=V3pp-\Delta pp5 \tag{8}$$

1.6 Effects

According to the first embodiment, the liquid-crystal display apparatus includes the pulldown voltage correction circuit 600 including multiple adjustment capacitors respectively corresponding to multiple source bus lines SL arranged in the display 700. Each adjustment capacitor includes the first electrode supplied with the adjustment signal VAD and the second electrode connected to the source bus line SL. In this configuration, the potential of the adjustment signal VAD rises immediately before the fall of the scanning signal. The pixel potential thus rises in the pixel formation region 70 included in a write target row of the video signal. The pulldown voltage in each pixel formation region 70 at the fall of the scanning signal may be cancelled by adjusting the amplitude of the adjustment signal VAD corresponding to each source bus line SL in view of the magnitude of the pulldown voltage occurring in the pixel formation region 70 connected to the source bus line SL. As a result, the optimum counter potential becomes constant on the whole display 700. By setting the common electrode potential to the constant potential, the occurrence of flickering, burn-in, and luminance unevenness may be controlled. The liquid-crystal display apparatus according to the first embodiment may control deterioration in display quality attributed to the magnitude of the pulldown voltage that is different from location to location on the whole display 700.

2. Second Embodiment

According to the first embodiment, the pulldown voltage correction circuit 600 is supplied with five adjustment signals VAD (the first through fifth adjustment signals V1 through V5). If the number of source bus lines SL increases in the display 700, the number of adjustment signals VAD may also increase to sufficiently control the deterioration in the display quality. By using a single adjustment signal VAD, a second embodiment provides a configuration that provides the same effects as the first embodiment.

2.1 Pulldown Voltage Correction Circuit

Figure 8:
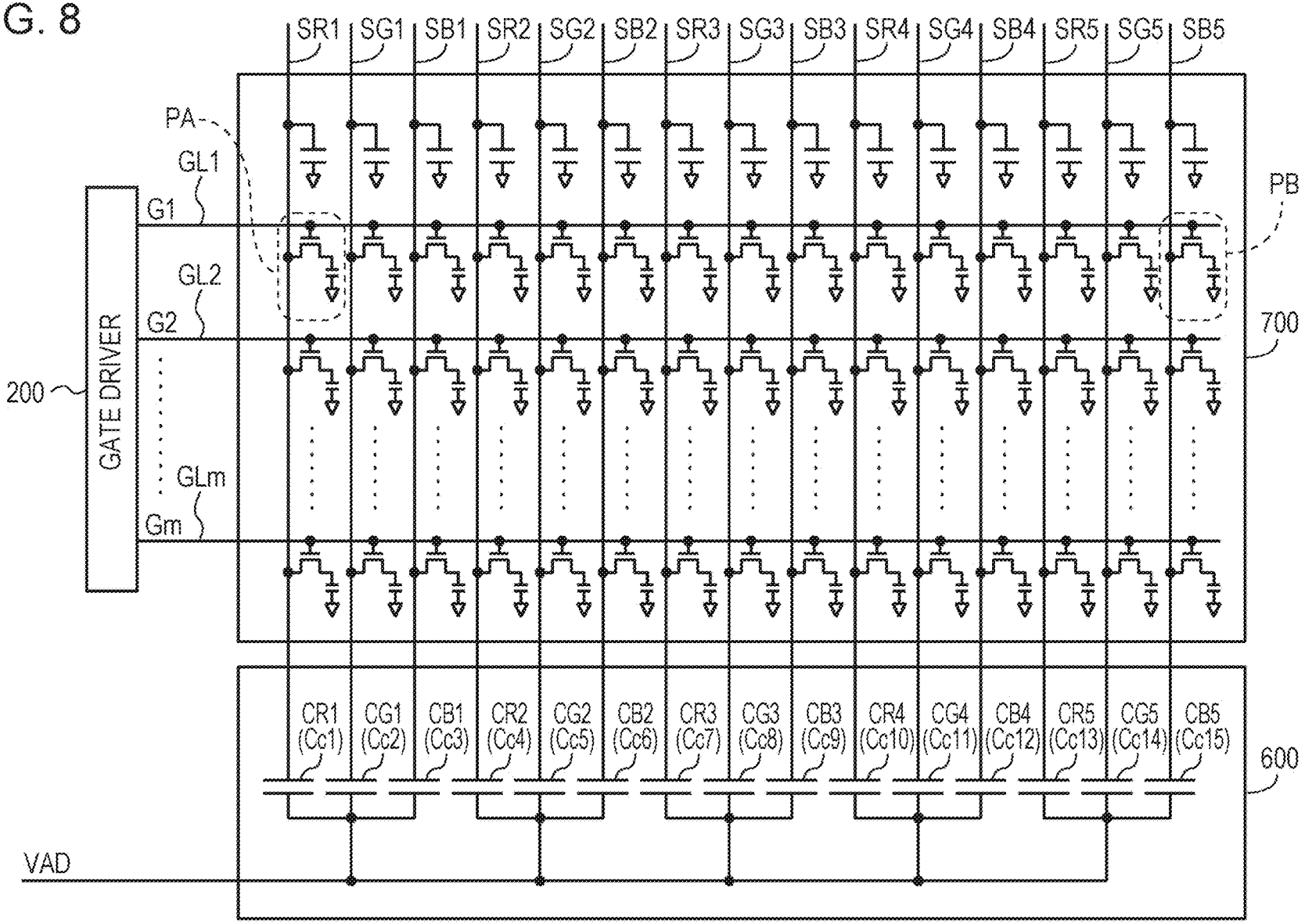
FIG. 8 illustrates a configuration of the pulldown voltage correction circuit of a second embodiment.

The configuration of the pulldown voltage correction circuit 600 of the second embodiment is described with reference to FIG. 8. In the second embodiment, like the first embodiment, the pulldown voltage correction circuit 600 includes 15 adjustment capacitors that respectively correspond to 15 source bus lines SL on a one-to-one correspondence basis. In the first embodiment, the capacitance values of the 15 adjustment capacitors are equal to each other. In the second embodiment, however, the capacitance values of the 15 adjustment capacitors are different from each other. The pulldown voltage correction circuit 600 is supplied with a single adjustment signal VAD. All the first electrodes of the 15 adjustment capacitors included in the pulldown voltage correction circuit 600 are thus supplied with the same adjustment signal VAD. In other words, all the first electrodes of the 15 adjustment capacitors in the pulldown voltage correction circuit 600 are supplied with the same potential.

The display 700 includes a large number of source bus lines SL in practice and the pulldown voltage correction circuit 600 includes accordingly a large number of adjustment capacitors. The whole display 700 is logically divided into multiple blocks and the adjustment capacitors are thus divided into groups that respectively correspond to the blocks on a one-to-one correspondence basis. The capacitance values of the adjustment capacitors are set to be different from group to group.

2.2 Operation

In the second embodiment, like in the first embodiment, the potential of the adjustment signal VAD rises immediately before the fall of the scanning signal and falls after the pixel potential falls in response to the fall of the scanning signal.

In the discussion herein, x represents 15 or a smaller integer, SLx represents a source bus line corresponding to an adjustment capacitor having a capacitance value Ccx, Cbusx represents a wiring capacitance of the source bus line SLx, and VADpp represents the amplitude of the adjustment signal VAD. An amount of change ΔVS(x) of the potential of the source bus line SLx in response to a rise of the potential of the adjustment signal VAD is expressed by Equation (9):

$$\Delta VS(x) = \frac{Ccx}{Ccx + C\,\mathrm{bus}\,x} \times VADpp \tag{9}$$

Since the pulldown voltage is higher as the distance from the gate driver 200 is shorter, capacitance values Cc1 through Cc15 are determined to satisfy the condition of ΔVS(1)>ΔVS(2)>ΔVS(3)> . . . >ΔVS(13)>ΔVS(14)>ΔVS(15).

The pixel potential in each pixel formation region 70 serving as a writing target of the video signal VS rises immediately before the fall of the scanning signal (time t5 in FIG. 5). The degree of rising of the pixel potential in the pixel formation region 70 is larger as the distance of the pixel formation region 70 is shorter from the gate driver 200. When the scanning signal falls (at time t6 in FIG. 5), the pixel potential lowers by the pulldown voltage in the pixel formation region 70 serving as the writing target of the video signal. The pulldown voltage is higher in the pixel formation region 70 as the distance of the pixel formation region 70 is shorter from the gate driver 200. As described above, the rise in the pixel potential immediately before the fall of the scanning signal and the decrease in the pixel potential cancel each other. In other words, the pulldown voltage at the fall of the scanning signal is cancelled in the pixel formation region 70.

2.3 Determination Method (Adjustment Method) of Amplitude of Adjustment Signal and Capacitance Value of Adjustment Capacitor Amplitude VADpp of the adjustment signal VAD and 15 capacitance values Cc1 through Cc15 of 15 adjustment capacitors are determined as described below. Predicted value of the pulldown voltage in a region corresponding to each of the 15 adjustment capacitors is determined by simulating a time constant of the gate bus line GL, characteristics of the TFTs forming the gate driver 200, wiring capacitances of the source bus lines SL, characteristics of the pixel TFTs 71, and parasitic capacitances. All these parameters predicted in the time of designing the liquid-crystal panel forming the liquid-crystal display apparatus. For example, the capacitance value Cc15 of the adjustment capacitor CB5 and the amplitude VADpp of the adjustment signal VAD are determined such that the predicted value of the pulldown voltage in the region PB is equal to the amount of change in the potential of the source bus line SL 15 responsive to the rise in the potential of the adjustment signal VAD. The capacitance values of the adjustment capacitors other than the adjustment capacitor CB5 are further determined. For example, the capacitance value Cc8 is determined such that the predicted value of the pulldown voltage in a region corresponding to the adjustment capacitance CG3 is equal to the amount of change in the potential of the source bus line SG3 responsive to the rise in the potential of the adjustment signal VAD. Before the volume production of liquid-crystal panels, prototype models undergo both verification of a display state after correction of each region (cancelling the pulldown voltage) and fine adjustment of the capacitance values Cc1 through Cc15 of the 15 adjustment capacitors.

Since the pulldown voltage is higher as the distance from the gate driver 200 is shorter, the capacitance values Cc1 through Cc15 are determined to satisfy the condition "Cc1>Cc2>Cc3> . . . >Cc13>Cc14>Cc15."

Multiple capacitors connected in parallel with each adjustment capacitor may be arranged beforehand and a laser cutter may be used to detach a capacitor such that the display state of a region corresponding to each adjustment capacitor is optimized (or a flickering value is minimized). The capacitance values of the adjustment capacitors may thus have optimum values.

2.4 Effects

According to the second embodiment, the capacitance values of the adjustment capacitors included in the pulldown voltage correction circuit 600 are different from each other. Even when all the first electrodes of the adjustment capacitors are supplied with the same adjustment signal VAD, the amount of change in the potential of the source bus line SL responsive to the rise in the potential of the adjustment signal VAD immediately before the fall of the scanning signal may be differentiated from source bus line SL to source bus line SL. By determining the capacitance value of each adjustment capacitor in view of the magnitude of the pulldown voltage generated in the pixel formation region 70 connected to each source bus line SL, the pulldown voltages in all the pixel formation regions 70 included in the display 700 may be cancelled using a single adjustment signal VAD. Using the single adjustment signal VAD, the liquid-crystal display apparatus of the second embodiment may thus provide the same effects as the first embodiment.

3. Third Embodiment

Figure 9:
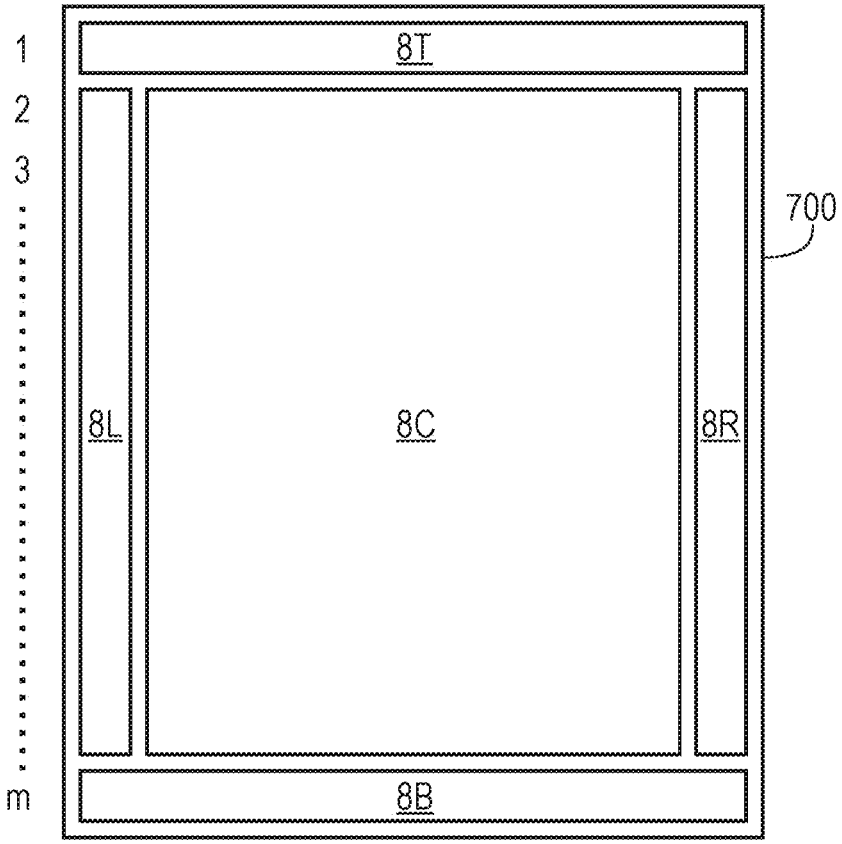
FIG. 9 illustrates a third embodiment.

The first and second embodiments may control a deterioration in the display quality attributed to the difference in the pulldown voltage in the direction of the extension of the gate bus line GL. However, a difference may occur in the magnitude of the pulldown voltage from region to region in the direction of the extension of the source bus line SL. For example, a difference may occur in the magnitude of the pulldown voltage between periphery regions (regions 8T, 8B, 8L, and 8R in FIG. 9) and remaining regions (region 8C in FIG. 9) in the display 700. Referring to FIG. 9, the region 8T is referred to as an top-end region 8T, the region 8B is referred to as a bottom-end region 8B, the region 8L is referred to as a left-side region 8L, the region 8R is referred to as a right-side region 8R, and the region 8C is referred to as a central region 8C.

There may be a case in which the pulldown voltage is relatively higher in the top-end region 8T, the bottom-end region 8B, the left-side region 8L, and the right-side region 8R while the pulldown voltage is relatively smaller in the central region 8C. According to a third embodiment, in the case described above, a deterioration in the display quality attributed to the difference in the magnitude of the pulldown voltage may be controlled.

According to the third embodiment, the top-end region 8T and the bottom-end region 8B correspond to a first region, and the left-side region 8L, the right-side region 8R, and the central region 8C correspond to a second region.

3.1 Pulldown Voltage Correction Circuit

The configuration of the pulldown voltage correction circuit 600 of the third embodiment is described with reference to FIG. 10. A region including all the pixel formation regions 70 connected to the gate bus line GL1 corresponds to the top-end region 8T. A region including all the pixel formation regions 70 connected to the gate bus line GLm corresponds to the bottom-end region 8B. A region including the pixel formation regions 70 at second through (m−1)-th rows connected to the source bus line SR1 corresponds to the left-side region 8L. A region including the pixel formation regions 70 at second through (m−1)-th rows connected to the source bus line SB5 corresponds to the right-side region 8R. A region including the remaining pixel formation regions 70 corresponds to the central region 8C.

According to the third embodiment, the pulldown voltage correction circuit 600 includes the 15 adjustment capacitors respectively corresponding to the 15 source bus lines SL on a one-to-one correspondence basis. In the third embodiment, as in the first embodiment, the capacitance values of the 15 adjustment capacitors in the pulldown voltage correction circuit 600 are equal to each other. The pulldown voltage correction circuit 600 is supplied with the first adjustment signal V1 and the second adjustment signal V2 as the adjustment signals VAD. The first electrodes of the adjustment capacitors CR1 and CB5 are supplied with the first adjustment signal V1. The first electrodes of adjustment capacitors CG1, CB1, CR2, CG2, CB2, CR3, CG3, CB3, CR4, CG4, CB4, CR5 and CG5 are supplied with the second adjustment signal V2.

In this way, the first adjustment signal V1 is applied to the first electrode of the adjustment capacitor having the second electrode connected to the source bus line SL in close-to-end regions of the gate bus line GL in the display 700. The second adjustment signal V2 is applied to the first electrode of the adjustment capacitor having the second electrode connected to the source bus line SL in a region other than the close-to-end regions of the gate bus line GL in the display 700.

3.2 Operation

Figure 11:
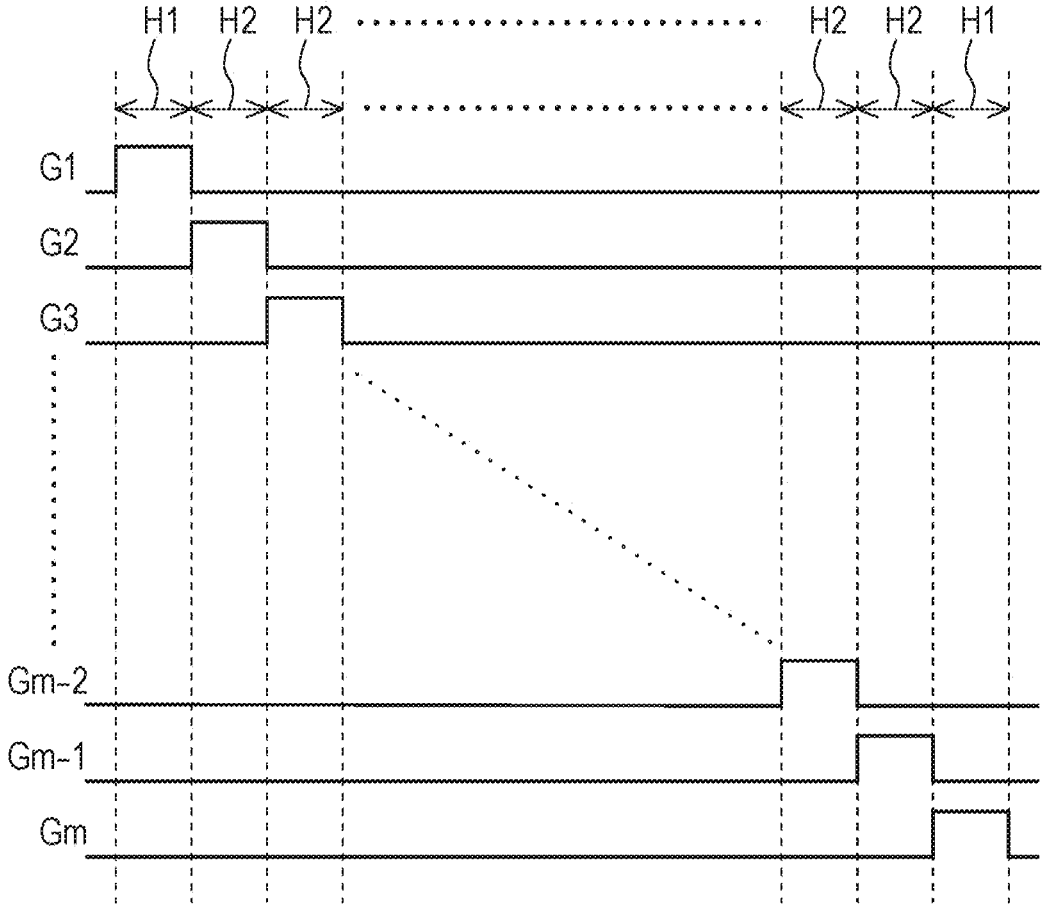
FIG. 11 is a waveform diagram illustrating a first-type horizontal scanning period and a second-type horizontal scanning period in the third embodiment.

The operation of the third embodiment is described. The amplitude of the second adjustment signal V2 is different between during the horizontal scanning period throughout which the video signal is written on the pixel formation regions 70 included in the top-end region 8T or the bottom-end region 8B and during the horizontal scanning period throughout which the video signal is written on the pixel formation regions 70 in the remaining region. In the following discussion, the horizontal scanning period throughout which the video signal is written on the pixel formation regions 70 included in the top-end region 8T or the bottom-end region 8B is referred to as a first-type scanning period and the horizontal scanning period throughout which the video signal is written on the pixel formation regions 70 in the remaining region is referred to as a second-type scanning period. The first-type scanning period is denoted by H1 and the second-type scanning period is denoted by H2 (see FIG. 11). The adjustment signal output circuit 500 makes the amplitude of the second adjustment signal V2 during the second-type scanning period H2 smaller than the amplitude of the second adjustment signal V2 during the first-type scanning period H1.

A gate bus line connected to only the pixel formation region 70 having a pulldown voltage higher than a predetermined threshold value is referred to as a "first-type gate bus line." A gate bus line connected to the pixel formation region 70 having the pulldown voltage higher than the threshold value and the pixel formation region 70 having the pulldown voltage lower than the threshold value is referred to as a "second-type gate bus line". The liquid-crystal capacitor Clc included in the pixel formation region 70 connected to the first-type gate bus line is charged during the first-type scanning period H1. The liquid-crystal capacitor Clc included in the pixel formation region 70 connected to the second-type gate bus line is charged during the second-type scanning period H2.

Figure 12:
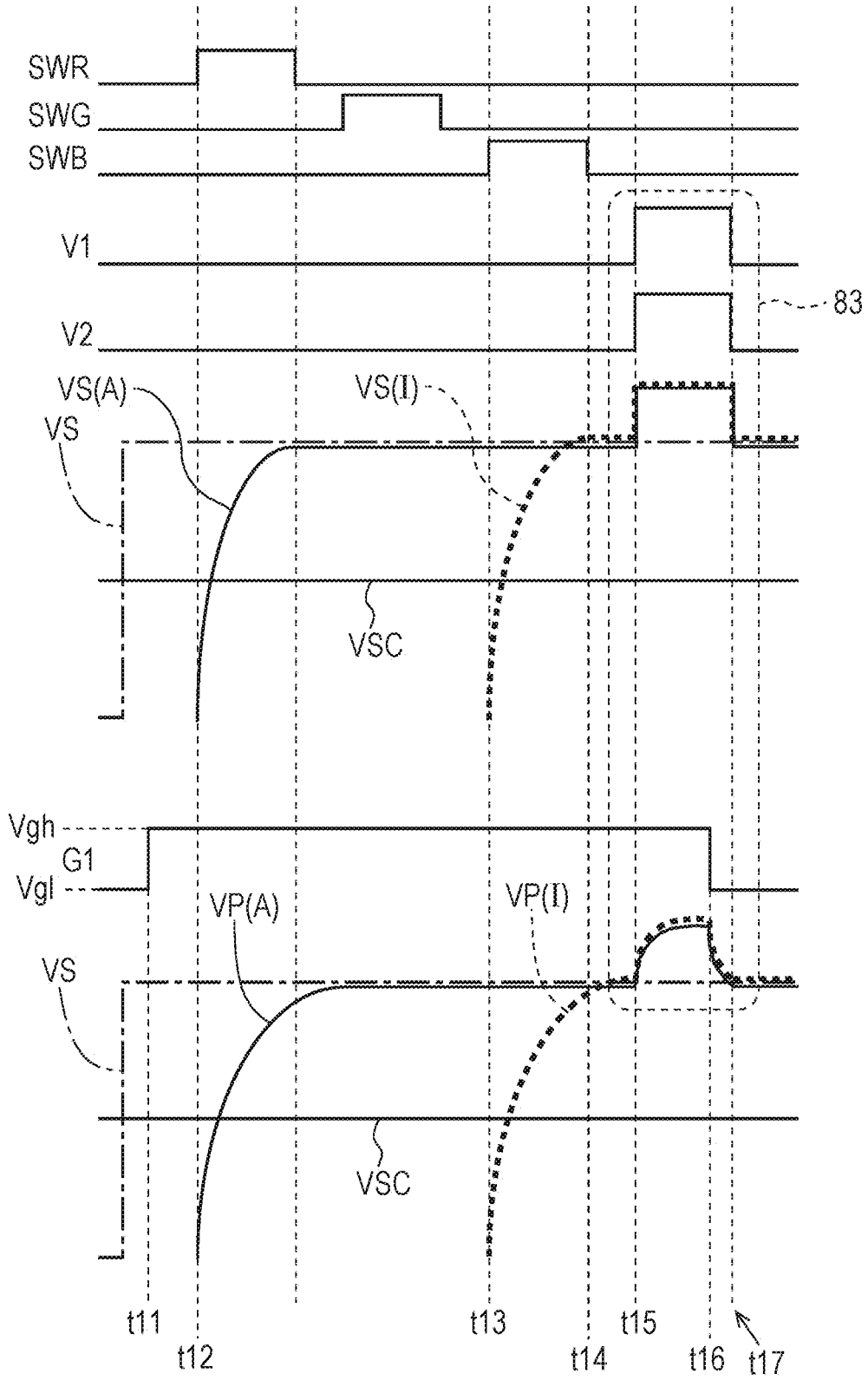
FIG. 12 is a waveform diagram illustrating an operation during the first-type scanning period in the third embodiment.
Figure 13:
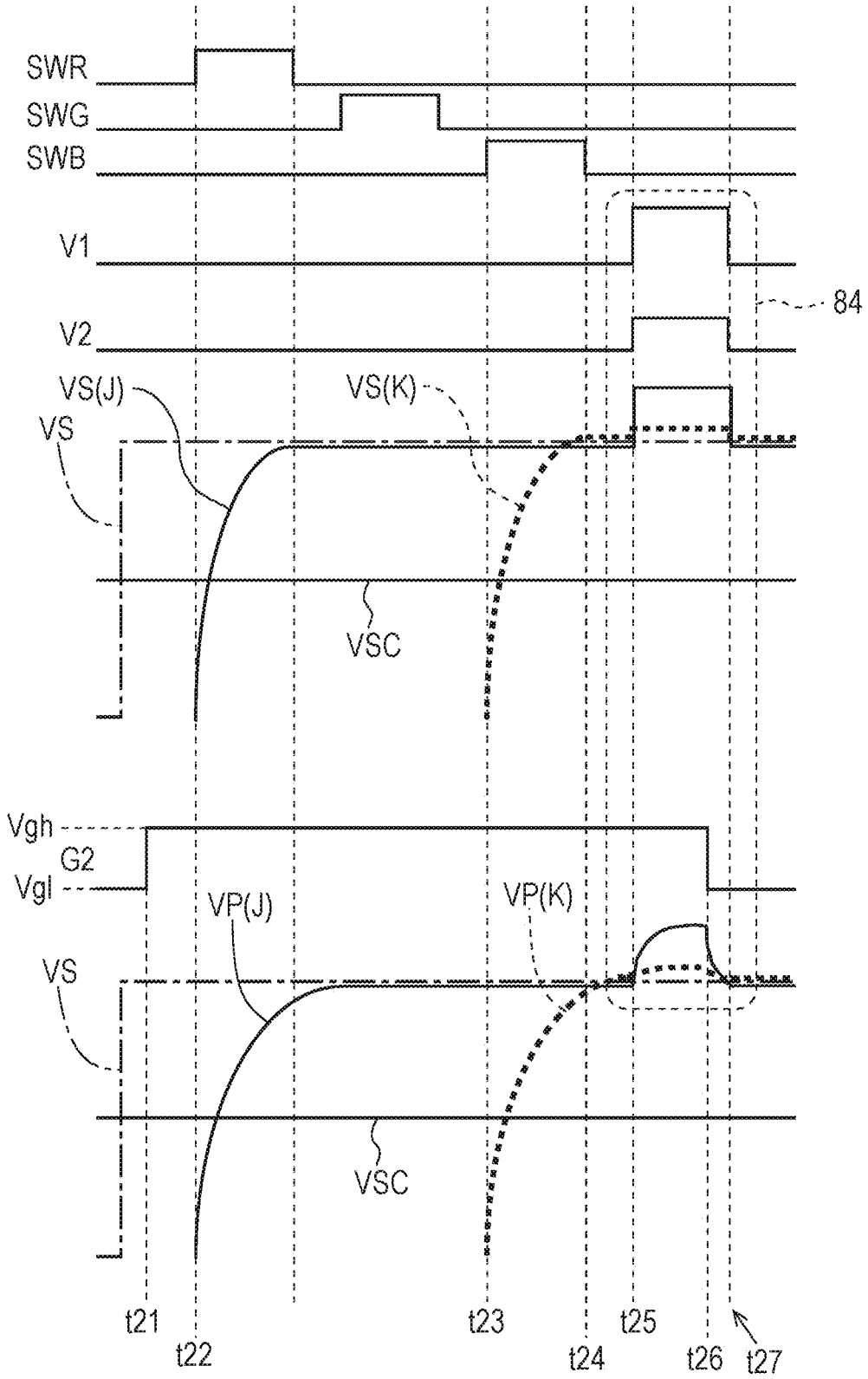
FIG. 13 is a waveform diagram illustrating an operation during the second-type horizontal scanning period in the third embodiment.
Figure 14:
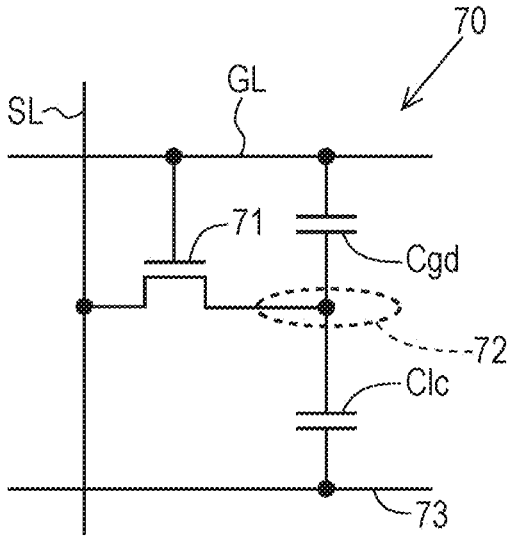
FIG. 14 illustrates a circuit of a pixel formation region.

FIG. 12 is a waveform diagram during the first-type scanning period H1 and FIG. 13 is a waveform diagram during the second-type scanning period H2. The operation described herein is performed in the positive writing. In the negative writing as well, the first adjustment signal V1 and the second adjustment signal V2 vary in the same way as in the positive writing.

For the convenience of explanation, a region PI represents a region including the pixel formation region 70 that is arranged at an intersection point of the gate bus line GL1 and the source bus line SB2. A region PJ represents a region including the pixel formation region 70 that is arranged at an intersection point of the gate bus line GL2 and the source bus line SR1. A region PK represents a region including the pixel formation region 70 that is arranged at an intersection point of the gate bus line GL2 and the source bus line SB2. The region PA and the region PI are included in the top-end region 8T. The region PJ is included in the left-side region 8L. The region PK is included in the central region 8C. VS(I) represents the potential of the source bus line SB2 in the region PI. VS(J) represents the potential of the source bus line SR1 in the region PJ. VS(K) represents the potential of the source bus line SB2 in the region PK. VP(I) represents the pixel potential in the region PI. VP(J) represents the pixel potential in the region PJ. VP(K) represents the pixel potential in the region PK.

The operation performed during the first-type scanning period H1 is described with reference to FIG. 12. When the scanning signal G1 rises at time t11, the TFTs 71 transitions from the off-state to the on-state in the region PA and the region PI.

When the switch control signal SWR transitions from the low level to the high level at time t12, the source bus line SR1 is charged in response to the video signal VS. The TFT 71 is in the on-state in the region PA. The liquid-crystal capacitor Clc is thus charged in response to a charging voltage of the source bus line SR1 in the region PA and the pixel potential VP(A) approaches the potential of the video signal VS. When the switch control signal SWR transitions from the high level to the low level, the source bus line SR1 becomes floating.

When the switch control signal SWB transitions from the low level to the high level at time t13, the source bus line SB2 is charged in response to the video signal VS. The TFT 71 is then in the on-state in the region PI. In the region PI, the liquid-crystal capacitor Clc is charged in response to a charging voltage of the source bus line SB2 and the pixel potential VP(I) approaches the potential of the video signal VS. When the switch control signal SWB transitions from the high level to the low level at time t14, the source bus line SB2 becomes floating.

At time t15, the potentials of the first adjustment signal V1 and the second adjustment signal V2 rise as illustrated in FIG. 12. The potentials of the first adjustment signal V1 and the second adjustment signal V2 are identical in terms of the degree of rising. As the potential of the first adjustment signal V1 rises, the potential VS(A) of the source bus line SR1 rises via the adjustment capacitor CR1 and as the potential of the second adjustment signal V2 rises, the potential VS(I) of the source bus line SB2 via the adjustment capacitor CB2. Since the amplitudes of the first adjustment signal V1 and the second adjustment signal V2 are equal to each other, an amount of change in the potential VS(A) of the source bus line SR1 is equal to an amount of change in the potential VS(I) of the source bus line SB2.

Since the scanning signal G1 is kept at the high level at time t15, the TFTs 71 remain in the on-state in the region PA and the region PI. As the potential VS(A) of the source bus line SR1 rises, the pixel potential VP(A) in the region PA rises, and as the potential VS(I) of the source bus line SB2 rises, the pixel potential VP(I) in the region PI rises. The pixel potential VP(A) and the pixel potential VP(I) rise in the same way.

At time t16, the scanning signal G1 falls and the TFTs 71 transition from the on-state to the off-state in the region PA and the region PI. The pixel potential lowers by the pulldown voltage in the region PA and the region PI. In this example, the magnitude of the pulldown voltage in the region PA is equal to the magnitude of the pulldown voltage in the region PI. In the region PA and the region PI, the pixel potential at a lowered level remains until the start of writing of the next video signal VS.

At time t17, the potentials of the first adjustment signal V1 and the fifth adjustment signal V5 fall to the potential at the level immediately before time t15. In this way, the potential VS(A) of the source bus line SR1 and the potential VS(I) of the source bus line SB2 lower to the level immediately before time t15. The TFTs 71 are in the off-state in the region PA and the region PI. No change occurs in the pixel potentials in the region PA and the region PI.

The operation during the second-type scanning period H2 is described with reference to FIG. 13. When the scanning signal G2 rises at time t21, the TFTs 71 transition from the off-state to the on-state in the region PJ and the region PK.

When the switch control signal SWR transitions from the low level to the high level at time t22, the source bus line SR1 is charged in response to the video signal VS. The TFT 71 is in the on-state in the region PJ. In the region PJ, the liquid-crystal capacitor Clc is charged in response to a charging voltage of the source bus line SR1 and the potential voltage VP(J) approaches the potential of the video signal VS. When the switch control signal SWR transitions from the high level to the low level, the source bus line SR1 becomes floating.

When the switch control signal SWB transitions from the low level to the high level at time t23, the source bus line SB2 is charged in response to the video signal VS. In the region PK, the TFT 71 is in the on-state. In the region PK, the liquid-crystal capacitor Clc is charged with a charging voltage of the source bus line SB2 and the pixel potential VP(K) approaches the potential of the video signal VS. When the switch control signal SWB transitions from the high level to the low level at time t24, the source bus line SB2 becomes floating.

The potentials of the first adjustment signal V1 and the second adjustment signal V2 rise at time t25 as illustrated in FIG. 13. The degree of rising of the potential is higher in the first adjustment signal V1 than in the second adjustment signal V2. As the potential of the first adjustment signal V1 rises, the potential VS(J) of the source bus line SR1 rises via the adjustment capacitor CR1 and as the potential of the second adjustment signal V2 rises, the potential VS(K) of the source bus line SB2 rises via the adjustment capacitor CB2. Since the amplitude of the first adjustment signal V1 is larger than the amplitude of the second adjustment signal V2, an amount of change in the potential VS(J) of the source bus line SR1 is larger than an amount of change in the potential VS(K) of the source bus line SB2.

Since the scanning signal G2 remains at the high level at time t25, the TFTs 71 also remain in the on-state in the region PJ and the region PK. As the potential VS(J) of the source bus line SR1 rises, the pixel potential VP(J) in the region PJ rises and as the potential VS(K) of the source bus line SB2 rises, the pixel potential VP(K) in the region PK rises. With reference to FIG. 13, immediately before the scanning signal G2 falls, the pixel potential VP(J) in the region PJ is higher than the pixel potential VP(K) in the region PK.

At time t26, the scanning signal G2 falls, and the TFTs 71 transition from the on-state to the off-state in the region PJ and the region PK. The pixel potential lowers by the pulldown voltage in the region PJ and the region PK. In this case, the pulldown voltage in the region PJ is higher than the pulldown voltage in the region PK. In the region PJ and the region PK, the pixel potential remains at the lower level until the writing of the next video signal VS starts.

At time t27, the potentials of the first adjustment signal V1 and the fifth adjustment signal V5 fall to the potentials at the level immediately before time t25. The potential VS(J) of the source bus line SR1 and the potential VS(K) of the source bus line SB2 also fall to the potentials at the level immediately before time t25. In the region PJ and the region PK, the TFTs 71 are in the off-state in the region PJ and the region PK. No change occurs in the pixel potentials in the region PJ and the region PK.

According to the third embodiment, the multiple horizontal scanning periods in one vertical scanning period include the first-type scanning period H1 throughout which the adjustment signal output circuit 500 equalizes the amplitude of the first adjustment signal V1 and the amplitude of the second adjustment signal V2 and the second-type scanning period H2 throughout which the adjustment signal output circuit 500 differentiates the amplitude of the first adjustment signal V1 from the amplitude of the second adjustment signal V2. The adjustment signal output circuit 500 thus equalizes the amplitude of the first adjustment signal V1 during the first-type scanning period H1 and the amplitude of the first adjustment signal V1 during the second-type scanning period H2 and differentiates the amplitude of the second adjustment signal V2 during the first-type scanning period H1 from the amplitude of the second adjustment signal V2 during the second-type scanning period H2.

According to the third embodiment, the rising of the scanning signal is performed in the operation carried out at time t11 and time t21, the liquid-crystal capacitor charging is performed in the operation carried out from time t12 to time t14 and from time t22 to time t24, the overcharging is performed in the operation carried out from time t15 to time t16 and from time t25 to time t26, and the falling of the scanning signal is performed in the operation carried out at time t16 and time t26.

3.3 Effects

According to the third embodiment, out of the first adjustment signal V1 and the second adjustment signal V2 serving as the adjustment signals VAD, the second adjustment signal V2 is different in amplitude between the first-type scanning period H1 and the second-type scanning period H2. During the first-type scanning period H1, the video signal VS is written on the pixel formation regions 70 included in the top-end region 8T or the bottom-end region 8B. During the second-type scanning period H2, the video signal is written on the pixel formation regions 70 in the remaining regions (the left-side region 8L, the right-side region 8R, and the central region 8C). Specifically, the amplitude of the second adjustment signal V2 during the second-type scanning period H2 is smaller than the amplitude of the second adjustment signal V2 during the first-type scanning period H1. For this reason, the degree of rising of the pixel potential in response to the rise of the second adjustment signal V2 is smaller in the central region 8C than in the top-end region 8T and the bottom-end region 8B. The pulldown voltage at the fall of the scanning signal may thus be cancelled in the case in which the pulldown voltage is lower in the central region 8C than in the top-end region 8T and the bottom-end region 8B.

Figure 10:
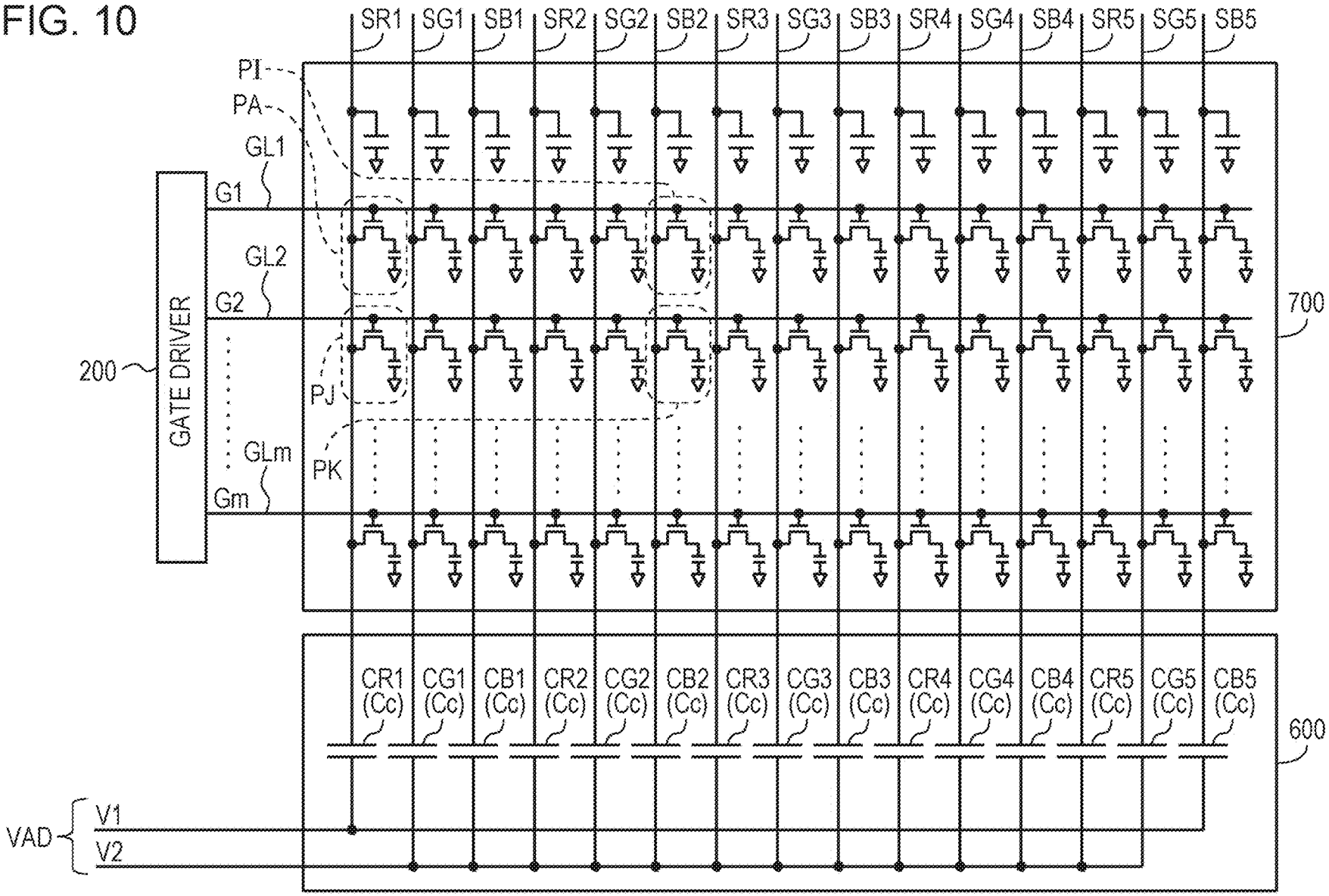
FIG. 10 illustrates a configuration of the pulldown voltage correction circuit of the third embodiment.

The configuration illustrated in FIG. 10 is described for exemplary purposes only. The number of adjustment signals VAD in use, the amplitude of each adjustment signal VAD during each horizontal scanning period, and the capacitance value of each adjustment capacitor may be determined as appropriate. Deterioration in the display quality attributed to the pulldown voltage that is different from location to location may be controlled over the whole display 700. In some cases, the adjustment signal VAD may be prepared for each source bus line SL and the amplitude of the adjustment signal VAD may be changed from horizontal scanning period to horizontal scanning period. The pulldown voltage may thus be cancelled in the pixel formation region 70.

Other Embodiments

The disclosure has been described in greater detail. The description of the disclosure is exemplary and non-limiting. Changes and modification may be implemented without departing from the scope of the disclosure. For example, the driving method of the source bus line is the SSD in each of the above-described embodiments. The disclosure may be similarly applicable to a liquid-crystal display apparatus that does not employ the SSD.

The present disclosure contains subject matter related to that disclosed in Japanese Priority Patent Application JP 2021-162779 filed in the Japan Patent Office on Oct. 1, 2021, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid-crystal display apparatus having a display including a plurality of video signal lines, a plurality of scanning signal lines intersecting the video signal lines, and a plurality of pixel formation regions that are arranged at intersection points where the video signal lines and the scanning signal lines intersect each other, the liquid-crystal display apparatus comprising:

a video signal line driving circuit that applies a video signal to the video signal lines;

a scanning signal line driving circuit that applies a scanning signal to the scanning signal lines;

a common electrode that is supplied with a constant potential;

a plurality of adjustment capacitors that respectively correspond to the video signal lines on a one-to-one correspondence basis; and an adjustment signal output circuit that outputs a plurality of adjustment signals that are different from each other in amplitude; wherein each of the pixel formation regions includes:

a pixel electrode;

a pixel transistor that includes a control terminal connected to a corresponding scanning signal line, a first conductive terminal connected to a corresponding video signal line, and a second conductive terminal connected to the pixel electrode; and a liquid-crystal capacitor that is created by the pixel electrode and the common electrode;

each of the adjustment capacitors includes:

a first electrode; and a second electrode connected to a corresponding video signal line;

a potential of the first electrode is raised after the liquid-crystal capacitor is charged with the video signal applied to the video signal line corresponding to the pixel formation region including the pixel transistor that transitions into an on-state in response to a rise of the scanning signal caused by the scanning signal line driving circuit and before the scanning signal line driving circuit causes the scanning signal to fall;

the adjustment capacitors are equal to each other in capacitance value;

the adjustment capacitors are divided into a plurality of groups;

the groups respectively correspond to the adjustment signals on a one-to-one correspondence basis;

the first electrode of the adjustment capacitor forming each of the groups is supplied with a corresponding adjustment signal; and the amplitude of each of the adjustment signals is larger as a distance between the video signal line connected to the second electrode of the adjustment capacitor forming a corresponding group and the scanning signal line driving circuit is shorter.

2. The liquid-crystal display apparatus according to claim 1, wherein the amplitude of each of the adjustment signals is determined in view of a magnitude of a pulldown voltage that is caused in response to a fall of the scanning signal in the pixel formation region connected to the video signal line connected to the second electrode of the adjustment capacitor forming a corresponding group.

3. The liquid-crystal display apparatus according to claim 1, wherein the adjustment signal output circuit equalizes the amplitude of each of the adjustment signals throughout all horizontal scanning periods.

4. A liquid-crystal display apparatus having a display including a plurality of video signal lines, a plurality of scanning signal lines intersecting the video signal lines, and a plurality of pixel formation regions that are arranged at intersection points where the video signal lines and the scanning signal lines intersect each other, the liquid-crystal display apparatus comprising:

a video signal line driving circuit that applies a video signal to the video signal lines;

a scanning signal line driving circuit that applies a scanning signal to the scanning signal lines;

a common electrode that is supplied with a constant potential;

a plurality of adjustment capacitors that respectively correspond to the video signal lines on a one-to-one correspondence basis; and an adjustment signal output circuit that outputs a plurality of adjustment signals that are different from each other in amplitude; wherein each of the pixel formation regions includes:

a pixel electrode;

a pixel transistor that includes a control terminal connected to a corresponding scanning signal line, a first conductive terminal connected to a corresponding video signal line, and a second conductive terminal connected to the pixel electrode; and a liquid-crystal capacitor that is created by the pixel electrode and the common electrode;

each of the adjustment capacitors includes:

a first electrode; and a second electrode connected to a corresponding video signal line;

a potential of the first electrode is raised after the liquid-crystal capacitor is charged with the video signal applied to the video signal line corresponding to the pixel formation region including the pixel transistor that transitions into an on-state in response to a rise of the scanning signal caused by the scanning signal line driving circuit and before the scanning signal line driving circuit causes the scanning signal to fall;

the adjustment capacitors are equal to each other in capacitance value;

the adjustment capacitors are divided into a plurality of groups;

the groups respectively correspond to the adjustment signals on a one-to-one correspondence basis;

the first electrode of the adjustment capacitor forming each of the groups is supplied with a corresponding adjustment signal;

the adjustment signals include at least a first adjustment signal and a second adjustment signal;

a plurality of horizontal scanning periods forming a vertical scanning period include a first-type horizontal scanning period throughout which the adjustment signal output circuit equalizes the amplitude of the first adjustment signal and the amplitude of the second adjustment signal and a second-type horizontal scanning period throughout which the adjustment signal output circuit differentiates the amplitude of the first adjustment signal from the amplitude of the second adjustment signal; and the adjustment signal output circuit equalizes the amplitude of the first adjustment signal during the first-type horizontal scanning period and the amplitude of the first adjustment signal during the second-type horizontal scanning period and differentiates the amplitude of the second adjustment signal during the first-type horizontal scanning period from the amplitude of the second adjustment signal during the second-type horizontal scanning period.

5. The liquid-crystal display apparatus according to claim 4, wherein a first region is defined to be a close-to-end region of the video signal lines, within a region of the display and a second region is defined to be the region of the display excluding the first region, where liquid-crystal capacitors included in the pixel formation regions within the first region are charged during the first-type horizontal scanning period and wherein liquid-crystal capacitors included in the pixel formation regions within the second region are charged during the second-type horizontal scanning period.

6. The liquid-crystal display apparatus according to claim 5, wherein the first adjustment signal is applied to the first electrode of the adjustment capacitor having the second electrode connected to the video signal line arranged in the close-to-end region of the scanning signal lines, out of the region of the display, wherein the second adjustment signal is applied to the first electrode of the adjustment capacitor having the second electrode connected to the video signal line arranged in a region, other than the close-to-end region of the scanning signal lines, out of the region of the display, and wherein the adjustment signal output circuit makes smaller the amplitude of the second adjustment signal during the second-type horizontal scanning period than the amplitude of the second adjustment signal during the first-type horizontal scanning period.

7. The liquid-crystal display apparatus according to claim 4, wherein a first-type scanning signal line is defined to be the scanning signal line that is connected to only the pixel formation region where a magnitude of a pulldown voltage caused in response to the fall of the scanning signal is larger than a threshold value, and a second-type scanning signal line is defined to be the scanning signal line that is connected to both the pixel formation region where the magnitude of the pulldown voltage is higher than the threshold value and the pixel formation region where the magnitude of the pulldown voltage is smaller than the threshold value, wherein liquid-crystal capacitors in the pixel formation regions connected to the first-type scanning signal line are charged during the first-type horizontal scanning period, and wherein liquid-crystal capacitors in the pixel formation regions connected to the second-type scanning signal line are charged during the second-type horizontal scanning period.

* * * * *